US012304763B2

(12) United States Patent
Neiberger et al.

(10) Patent No.: US 12,304,763 B2
(45) Date of Patent: May 20, 2025

(54) SHEET MATERIAL DISPENSE AND CUTTING SYSTEMS AND METHODS OF USE

(71) Applicant: ALLEN REED COMPANY, INC., Valencia, CA (US)

(72) Inventors: Sean Neiberger, Valencia, CA (US); Robert Davis, Carbondale, CO (US); Ian Kaiser, Malibu, CA (US)

(73) Assignee: Allen Reed Company, Inc.

( * ) Notice: Subject to any disclaimer, the term of this patent is extended or adjusted under 35 U.S.C. 154(b) by 83 days.

(21) Appl. No.: 17/081,897

(22) Filed: Oct. 27, 2020

(65) Prior Publication Data

US 2021/0139265 A1 May 13, 2021

Related U.S. Application Data

(60) Provisional application No. 62/932,683, filed on Nov. 8, 2019.

(51) Int. Cl.
*B65H 35/00* (2006.01)

(52) U.S. Cl.
CPC ..... *B65H 35/0073* (2013.01); *B65H 35/002* (2013.01); *B65H 2301/5154* (2013.01)

(58) Field of Classification Search
CPC ..... B65D 83/0835; B65D 83/0841; B65D 83/0882; B65H 35/0006; B65H 35/04; B65H 35/0073; B65H 35/0086; B23D 61/18; B23D 61/121; Y10T 83/935
See application file for complete search history.

(56) References Cited

U.S. PATENT DOCUMENTS 735,586 A * 8/1903 Rabie ..... B23D 61/121 83/850
2,250,236 A * 7/1941 Bennett ..... B65D 83/0841 225/7
3,142,426 A 7/1964 Busse
3,929,050 A * 12/1975 Salzwedel ..... B23D 61/121 83/848
4,196,647 A 4/1980 Fish
4,960,022 A * 10/1990 Chuang ..... B26D 1/105 83/175
5,440,961 A * 8/1995 Lucas, Jr. ..... B65H 35/04 83/578
6,223,639 B1 * 5/2001 Chen ..... B26F 3/02 225/93

(Continued)

FOREIGN PATENT DOCUMENTS

CH 703368 A2 * 12/2011 ..... A47J 47/01
EP 1845035 A2 * 10/2007 ..... B26D 1/045

(Continued)

OTHER PUBLICATIONS

English translation of JP09142458. (Year: 1997).*

(Continued)

*Primary Examiner* — Jennifer S Matthews
(74) *Attorney, Agent, or Firm* — Rimon PC

(57) ABSTRACT

The present invention relates to sheet material dispensing and cutting systems and boxes and related mechanisms and components, including methods of manufacture, methods of use, and related kits.

3 Claims, 19 Drawing Sheets

(56) References Cited

U.S. PATENT DOCUMENTS

| | | | | |
|---|---|---|---|---|
| 6,851,592 | B1 * | 2/2005 | Owen | B65H 35/002 83/848 |
| 7,921,756 | B2 * | 4/2011 | Vegliante | B26D 1/065 83/614 |
| 2006/0202079 | A1 * | 9/2006 | Pavlik | B65H 35/0086 242/562 |
| 2008/0201964 | A1 * | 8/2008 | Camargo | B23D 61/121 83/13 |
| 2015/0203313 | A1 | 7/2015 | Kaiser | |
| 2018/0141743 | A1 | 5/2018 | Vegliante | |
| 2020/0048025 | A1 * | 2/2020 | Amdahl | B65H 16/005 |

FOREIGN PATENT DOCUMENTS

| | | | | | |
|---|---|---|---|---|---|
| JP | 05262350 | A | * | 10/1993 | |
| JP | 09142458 | A | * | 6/1997 | B65D 83/0882 |
| JP | 2000033937 | A | * | 2/2000 | B65D 83/0882 |
| WO | 2021/091731 | A1 | | 5/2021 | |

OTHER PUBLICATIONS

International Search Report and Written Opinion received for PCT Application Serial No. PCT/US2020/057572 dated Feb. 3, 2021, 7 pages.

International Preliminary Report on Patentability received for PCT Application Serial No. PCT/US2020/057572 dated May 19, 2022, 7 pages.

* cited by examiner

All Figures on this page are considered Prior Art

All Figures on this page are considered Prior Art

Only Fig. 3A on this page is considered Prior Art

SHEET MATERIAL DISPENSE AND CUTTING SYSTEMS AND METHODS OF USE

CROSS-REFERENCE TO RELATED APPLICATIONS

The present application claims priority to U.S. Provisional Patent Application No. 62/932,683, filed on Nov. 8, 2019. The content of that application is incorporated herein by reference in its entirety.

BACKGROUND

Plastic film, metal foil, parchment, and other sheet materials or papers are used frequently in the food service businesses and domestically during cooking food and to package and preserve food. The film, foil and/or fabric or paper is/are typically dispensed in a sheet from a continuous roll contained in a cutter box, which functions as a dispenser in addition to a container for the roll of sheet material. A cutting blade is generally included on the cutter box or on a cardboard insert placed in the front of the cutter box to cut the material. Such cutting blades function as a cutting blade but also can injure the user of the dispenser when attempting to handle the material inside and in the process of cutting a section of material from the roll. To address these risks and to provide a uniform and predictable cut, more recent devices use a guide track with a sliding cutting blade for plastic material. While guide track devices produce relatively clean and safe cuts, they require two hands to operate in the cutting process and may fail due to improper set up or use.

Additionally, the dispenser box may fail to hold the roll or cutter due to aggressive use in food service kitchens or simply collapse or fail/buckle under load.

Another issue with these boxes in food service kitchens is that they are exposed to all manner of food and other contaminations while being used and are not easily cleaned as required for proper sanitary practices in food service operations. Complicating this issue has been the unapproved but often utilized practice for users to cut or remove the cutter box lid all together, exposing the roll to the environment and constant contamination risk. There has not been an effort by the food service industry to solve these and related issues.

Previous efforts have been to utilize the guide cutter to address safe cutting but this does not address or improve the functioning of the cutter box. The guide cutters currently available on the market have a primary goal of safety, which involved a change from a sharp straight edge to a hidden safety blade or track-based cutting.

Other solutions have attempted to eliminate the disposable cutter box entirely and to instead use a permanent dispenser. Permanent dispensers are more expensive and take up valuable space in a busy kitchen. Also, they rarely last inside a kitchen environment for a long period of time.

The present innovation addresses these and other related needs in the art.

SUMMARY

Provided herein are sheet material dispense and/or cutting systems, comprising a body having a lid lock portion adapted to secure a lid of a sheet material dispenser, an attachment portion adapted to attach to a portion of the sheet material dispenser, and a sheet material cutting portion adapted to cut the sheet material. Often, the system further comprises a sheet material cling portion adapted to impart a stabilizing force between the sheet material and the cling portion. Often, the cling portion is formed at least partially of a plastic, silicone or elastomer material comprising a plasticizer, or comprises a layer formed at least partially of a plastic or elastomer material comprising a plasticizer.

According to contemplated embodiments, the portion of the sheet material dispenser for attachment of the systems contemplated herein comprises a sheet material dispenser box or a sheet material dispenser box insert.

In certain frequent embodiments, the sheet material dispenser box is comprised of a housing having an upper portion and a lower portion, and each of the upper portion and the lower portion are configured to fit together in a nested configuration defining an open chamber area within the nested configuration, the upper portion further comprises a sheet material passage configured as an opening in an upper portion top wall of the upper portion, the sheet material passage extending along at least a portion of a length of the housing. Often in such embodiments, in the nested configuration a boundary gap 61 is present between the upper portion top wall and a plurality of upper portion side walls of the upper portion and a plurality of lower portion side walls. This boundary gap 61 is defined circumferentially around and laterally outside of the upper portion top wall and is the gap between the nested upper portion and lower portion. Often the sheet material cutting portion is configured on a support portion, and the support portion is shaped to fit securely within the boundary gap 61 in a manner that the sheet material cutting portion is positioned above the upper portion top wall. Frequently in such embodiments the sheet material dispenser box is comprised of polyethylene, high density polyethylene (HDPE), Acrylonitrile butadiene styrene (ABS), Polyethylene terephthalate (PET), Polyvinyl chloride (PVC), or a combination of two or more of the foregoing.

In certain embodiments of the sheet material dispenser box the lid lock portion is not present. Also in certain embodiments, the sheet material dispenser box the lid lock portion is not present and the attachment portion is not present. In these embodiments the sheet material cutting portion is often adapted on or attached to a support that is configured and sized to be positioned in the boundary gap 61. In certain related embodiments the sheet material cutting portion is attached to the upper portion top wall or a side wall of the sheet material dispenser box and is not a separate and removable portion. According to each embodiment of the sheet material dispenser box, the sheet material cutting portion may be any abrasive surface, blade or slide cutter described herein.

In certain embodiments, the housing of the sheet material dispenser box is adapted to define an open chamber area that can accept two or more different sheet material rolls within the open chamber area when the upper portion is nested with the lower portion.

In often included embodiments the attachment portion comprises a slip-on engagement, an adhesive, or another physical engagement with the sheet material dispenser. Frequently, the slip-on engagement comprises two or more support legs adapted to securely engage with a wall or an insert of the sheet material dispenser.

According to frequently included embodiments, the two or more support legs are spatially separated, defining a gap area therebetween, wherein the gap area has a width corresponding to a thickness of the wall or the insert of the sheet material dispenser such that when engaged with the wall or the insert of the sheet material dispenser the two or more support legs securely attach the sheet material cutting apparatus to the sheet material dispenser.

According to further contemplated embodiments, the sheet material cutting portion and/or the lid lock portion is/are removably attachable to the attachment portion. Often, wherein the sheet material cutting portion is positioned on the body at a location remote from the sheet material dispenser when the sheet material cutting apparatus is attached to the sheet material dispenser. Such a location remote from the sheet material dispenser frequently comprises a position vertically above or below a top surface of the sheet material dispenser, and/or laterally adjacent to a side surface of the sheet material dispenser.

According to frequently contemplated embodiments, the sheet material cutting portion comprises a blade, an abrasive surface, or a slide cutting apparatus.

In often included embodiments, the lid lock portion comprises a physical barrier adapted to prohibit the lid of the sheet material dispenser from lifting from a closed position in the dispenser when a sheet material is withdrawn from the dispenser. Frequently, the lid lock portion is physically separate from the attachment portion and the sheet material cutting portion. In certain frequent embodiments, the lid lock portion comprises a fastener adapted to lock the lid of the sheet material dispenser in a closed position in the dispenser.

According to often included embodiments, the sheet material cutting portion comprises a multi-serrated blade attached to the body, wherein the multi-serrated blade is defined by a blade length, a blade height and a blade tooth arrangement, the blade height being defined by a top region and bottom region, wherein the multi-serrated blade includes an attachment portion comprised in the bottom region and a cutting portion including the blade tooth arrangement comprised along the blade length in the top region; wherein the blade tooth arrangement comprises at least three different cutting regions, each having a collection of blade teeth comprising a uniformly-situated cutting surface direction, wherein the cutting surface direction is a different direction for each of the at least three different cutting regions.

Often the attachment portion comprises an adhesive for attachment to the sheet material dispenser.

In certain embodiments, each blade tooth of the collection the blade teeth comprises two surfaces meeting at an apex above the blade body, each of the blade teeth being capable of cutting sheet material, wherein the two surfaces comprise a hypotenuse side surface and an adjacent side surface. Often, the at least three cutting regions comprise two distal regions situated on opposite sides of a proximal region along the blade length. Also often, the hypotenuse side surface of the collection of blade teeth within each cutting region faces in a uniform direction, but the uniform direction is opposite-facing between the two distal regions. The hypotenuse side surface and the adjacent side surface of the collection of teeth in the proximal region frequently meet the blade body in certain embodiments at equal and opposite angles. Often the adjacent side surface of blade tooth in each of the two distal regions meets the blade body at between 85° to 95°. In certain embodiments the adjacent side surface of blade tooth in each of the two distal regions meets the blade body at between 45° to 150°. Also often, the adjacent side surface of blade tooth in each of the two distal regions meets the blade body at 90°. And further, often the at least two intersecting surfaces intersect at an angle of at or about 90°. The apex is also often positioned at or about 0.40 mm to at or about 0.50 mm from the blade body. Also often, the apex of each blade tooth of the collection the blade teeth is positioned at or about 0.40 mm to at or about 0.50 mm from the blade body. Frequently and often independent of other aspects of the present embodiments, the apex of each blade tooth of the collection the blade teeth is positioned at or about the same distance from the blade body. The apex, for example, is frequently positioned at or about 0.40 mm to at or about 0.50 mm from the blade body for each blade tooth in at least the proximal region, one of the two distal regions, or both of the two distal regions. Or, often the apex of each blade tooth of the collection the blade teeth is separated from an adjacent blade tooth along the blade length by a distance of between at or about 0.75 mm to at or about 0.85 mm. In frequent embodiments, the horizontal distance between the position the hypotenuse side surface and the adjacent side surface contact the blade body of one or more blade tooth of the collection the blade teeth is between about 0.50 mm to about 0.60 mm. Often, the length of each of the two distal regions comprise between about 10% to about 25% of the blade length. Also often, the length of each of the two distal regions comprise about 15% of the blade length.

According to often included embodiments, the lid lock portion and the attachment portion comprise an L-shaped body. Also often, the lid lock portion and the attachment portion are formed of a single contiguous material. The single contiguous material frequently comprises chip board, corrugated material, metal, PET or PVC. Frequently, the body is comprised of plastic.

According to frequent embodiments, the stabilizing force comprises static electricity, adhesion, friction, chemical means, or a mechanical means for retaining plastic sheet material. When adhesive is employed often the adhesive comprises a foam- or PVC-based tape.

In frequent embodiments, the multi-serrated blade is comprised of metal or plastic.

Methods of adapting a sheet material dispenser for easy and safe sheet material dispensing and cutting are also contemplated, comprising providing a sheet material dispenser having a roll of sheet material positioned there within; attaching the sheet material cutting system of the present disclosure to the sheet material dispenser.

Methods of dispensing plastic sheet material are also contemplated, comprising attaching the sheet material cutting system contemplated herein to a sheet material dispenser having a roll of sheet material positioned there within, wherein the sheet material comprises a continuous length of sheet material having a transverse edge at the end of the continuous length of sheet material; pulling the transverse end of the roll of sheet material to expose a length of sheet material and contacting the length of sheet material with the sheet material cutting portion; and severing the length of sheet material across the sheet material cutting portion to create a separated length of sheet material and a new transverse edge at the end of the continuous length of sheet material, wherein the new transverse edge is retained on the lid lock portion of the body. Though not wishing to be bound by any particular theory, electrostatic cling properties often act as the retention force. Often according to such methods the length of sheet material severed using a pressure applied to the sheet material on the sheet material cutting portion. Also often, the pressure comprises a pressure applied to one side, both sides, or the middle of the length of sheet material on the sheet material cutting portion.

These and other embodiments, features, and advantages will become apparent to those skilled in the art when taken with reference to the following more detailed description of various exemplary embodiments of the present disclosure in conjunction with the accompanying drawings.

BRIEF DESCRIPTION OF THE DRAWINGS

The skilled person in the art will understand that the drawings, described below, are for illustration purposes only.

FIG. 18D depicts a housing and sheet material cutting portion arranged for single sided dispense.

DETAILED DESCRIPTION

Figure 1A:
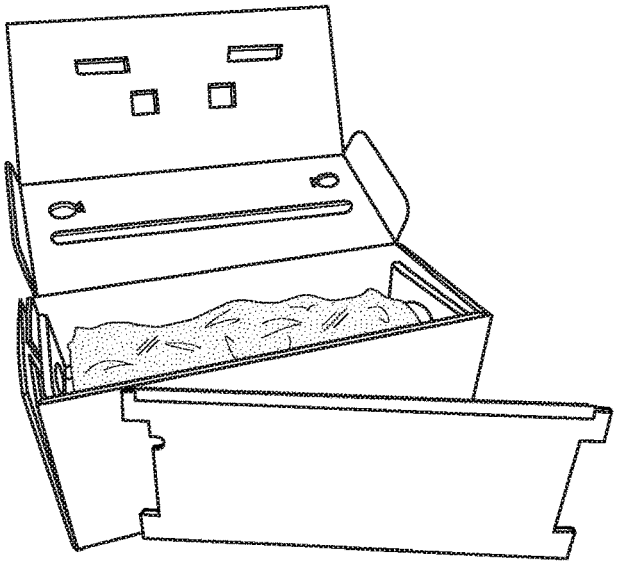
FIGS. 1A-1C depict an existing conventional sheet material cutting solution.

For clarity of disclosure, and not by way of limitation, the detailed description of the invention is divided into the subsections that follow.

As used herein, "a" or "an" means "at least one" or "one or more."

As used herein, the term "and/or" may mean "and," it may mean "or," it may mean "exclusive-or," it may mean "one," it may mean "some, but not all," it may mean "neither," and/or it may mean "both."

As used herein, the term "sheet material" refers to conventional roll-based or roll-stored plastic wrap/film, silicone, other polymer, metal foil, fabric, parchment and/or other paper.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference.

The focus for some time in the industry has been on safety, with research and products trending away from the use of a straight edge blade, and instead using rounded blades and track-based cutting. Nevertheless, the presently described cutting blade is adapted to cut safely while improving the overall function of the cutter box by locking the lid down, preventing it from popping up, when a desired length of sheet material is pulled from the roll through the lid and improving sanitation by keeping the lid in place.

The presently contemplated sheet material cutting portion or apparatus can be attached or incorporated, for example, using adhesive, to the front edge of any cutter box and over the lid of the box, which locks the lid down and prevents it from opening when pulling sheet material off its roll and through the lid. The presently contemplated sheet material cutting portion or apparatus can also be attached or incorporated, for example, by arranging the sheet material cutting portion or apparatus in operable connection with a housing for a sheet material, for example, by friction, pressure, adhesive, stapling, posting, staking, molding, co-molding, mated-attachment, or other similar mechanisms. In the presently contemplated embodiments, the teeth on the blade of the sheet material cutting portion provide a smooth, safe cut. Moreover, the cling strip or related aspect on the body of the sheet material cutting apparatus has cling properties that hold plastic wrap in place while the wrap is cut (see FIG. 4C). The cling strip also holds plastic wrap in place after use, preventing the plastic wrap going back inside cutter box or folding over (see FIG. 4D).

In certain embodiments, the sheet material cutting apparatus has an L-shaped profile body, often comprised of plastic material or another structurally rigid material. This body may be comprised of a variety of materials, including chip board, cardboard, plastic (including PET or PVC), or metal, and can be extruded, injection molded, blow molded, thermo form, thermo placing or folded into the L shape using rolling dies. When the body is formed of a material other than plastic, often a separate plastic cling strip is included to provide plastic cling properties during and after plastic sheet material is cut on the apparatus. The L shape design profile adds I-beam strength to the design in both horizontal and vertical directions. In frequently contemplated embodiments, the cutting blade of the apparatus is comprised of tin plate steel, having small teeth (described herein) that are often produced with a die cut cutting press. The blade is attached to the body of the apparatus using a staple-like process, where the metal is staked through the plastic or paper body the length of the blade, permanently attaching the blade to the body profile. The adhesive strip on the body attaches the body to a front edge of a sheet material cutter box. Though a variety of attachments are contemplated and described herein, adhesive made of foam or pvc based tapes with a tear away label are often preferred due to their ease of use and effective attachment. While adhesive on a single side of the body is often preferred due to ease of use, adhesive on both portions (i.e., top and side) of the L-shaped body is contemplated and within the scope of the present disclosure.

Figure 4A:
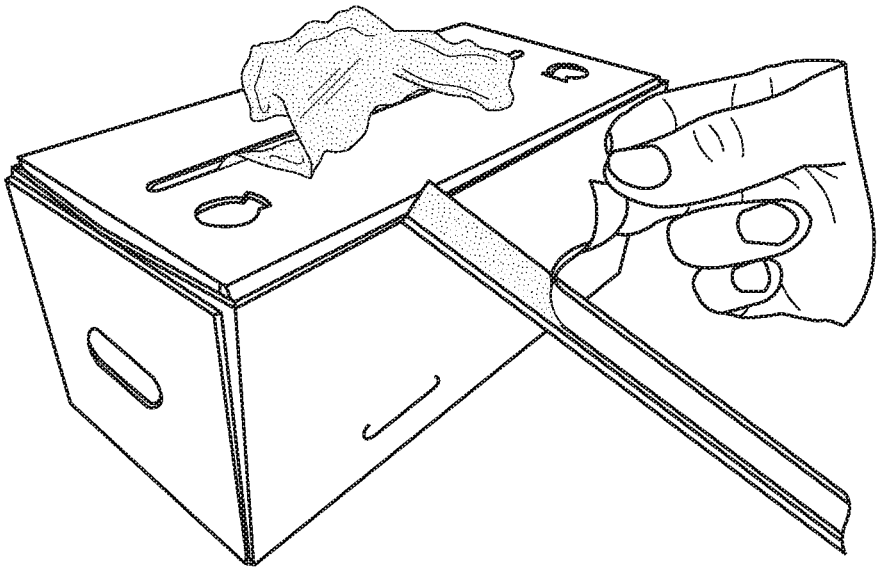
FIGS. 4A-4D depict the application of a new exemplary sheet material cutting system to a conventional sheet material dispenser and its use therewith.

In use, one would remove the sheet material cutting apparatus from inside its packaging and if an adhesive attachment is used, remove paper tape exposing the adhesive (see FIG. 4A). Then, the sheet material cutting apparatus would be placed onto a sheet material box lid and pressed down on front edge for permanent bonding to the box (see FIG. 4B). The cutter in this current position keeps the lid from opening when the user pulls a desired piece of sheet material through the lid. Moreover, according to the present embodiments, the blade is positioned at the optimal position located outside the box on the front edge, with nothing in front of it to come between the blade teeth and wrap. The L-shape body profile provides a natural I-beam design that adds vertical and horizontal strength to the cutter, keeping downward pressure on the lid and providing added strength to the front edge of the box.

Typically cutting blades are attached to a rectangle cardboard leaf that is inserted between the lid and front edge of cutter box (see FIG. 1A). The cardboard leaf with blade is lose and moves around inside cutter box, it often gets lost or bent because user removes the cutter box lid. The only benefit with a cutting blade on cardboard carrier is having the blade at an optimal height for cutting, it has no effect on improving the function of cutter box. By contrast, the presently contemplated sheet material cutting apparatus is permanently attached to the cutter box, securing and strengthening the box while keeping the blade at the optimal cutting height and, versus the conventional rectangle cardboard leaf cutting means, the presently contemplated sheet material cutting apparatus will not get lost or deform under repeated use.

The cling portion contemplated herein may be adapted to be suitable for the type of sheet material intended to be cut. For example, while plastic sheet material is contemplated with regard to the use of the term "cling" (i.e., electrostatic cling) the term "cling" is used more broadly herein to include sheet material retention. In the case of metal foil or parchment, a strip of silicone, wax or adhesive next to the blade may be employed as a cling portion to slow down the metal foil or parchment to permit a cleaner cut. This would hold the sheet material in place to increase friction for the cut and hold material after cut.

Figure 1B:
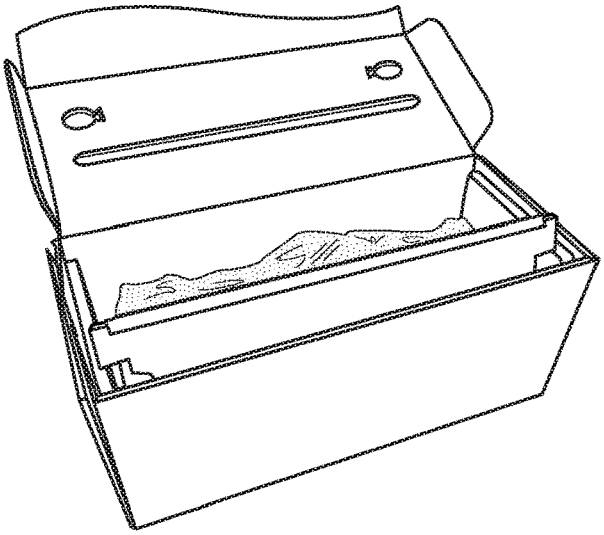
Figure 1C:
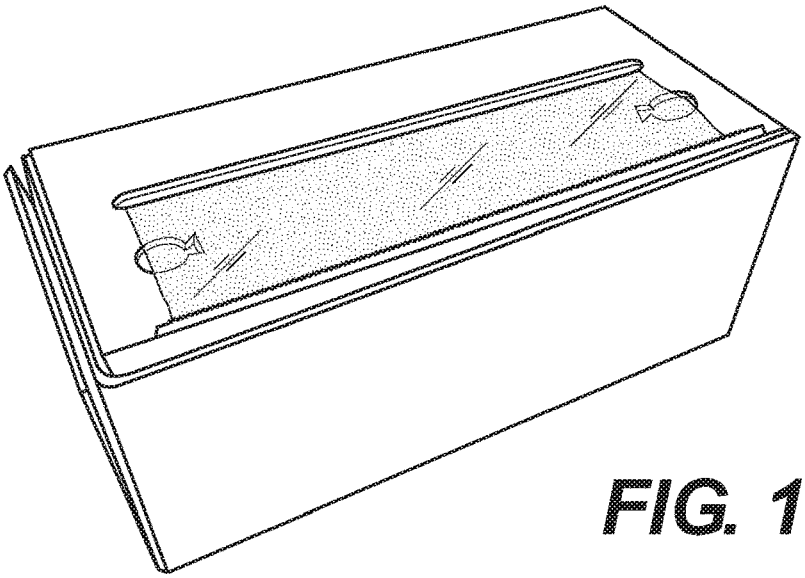

FIGS. 1A-1C depict the present state of the art of sheet material dispensing boxes and means used to cut the sheet material. As can be seen, the cutting means includes a cardboard leaf adapted to have a specific height that permits the cutting blade to stick up above the top of a brand-new sheet material dispensing box (FIG. 1A). In use the box is opened and the cardboard leaf is slid in in front of the roll of sheet material to be dispensed (FIG. 1B). Thereafter the top of the lid of the sheet material dispensing box is closed and the cardboard leaf is positioned between the box lid and the front wall of the box (FIG. 1C).

Figure 2A:
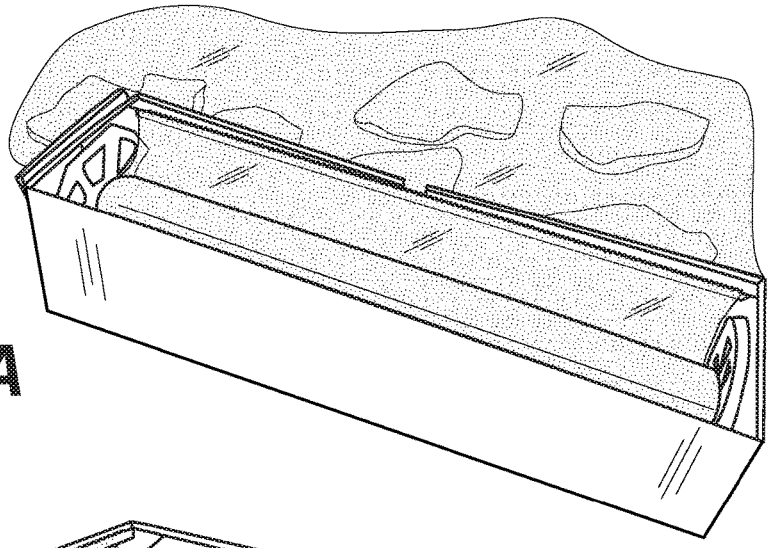
FIGS. 2A-2C depict sheet material dispensing boxes employing the existing conventional sheet material cutting solution with the dispenser lid removed FIGS. 1A-1C.
Figure 2B:
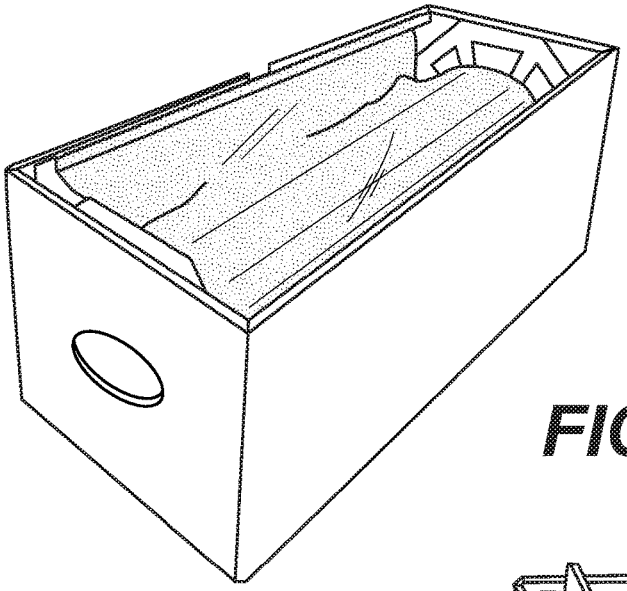
Figure 2C:
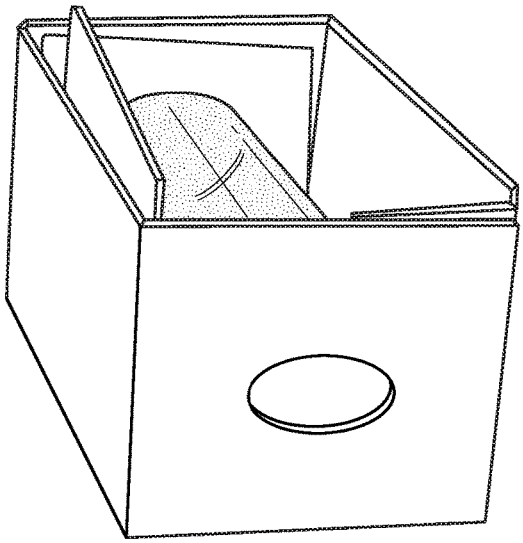
Figure 3A:
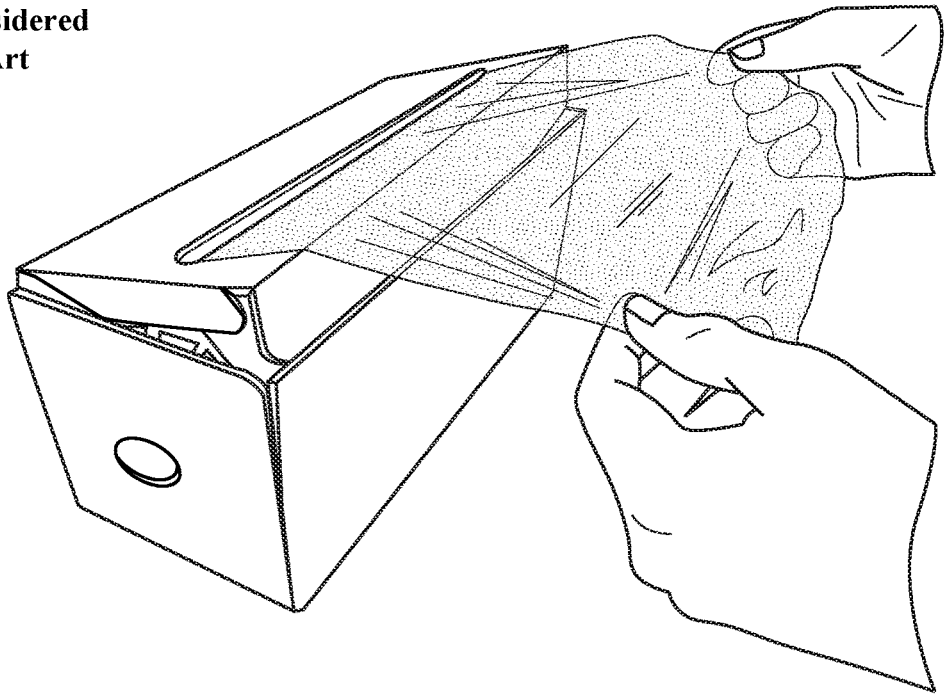
FIG. 3A depicts use of a conventional sheet material dispenser without the new exemplary sheet material cutting system.

Turning to FIGS. 2A-2C and 3A, the use and result of this current state of the art of sheet material dispensing boxes and means used to cut sheet material is depicted. As shown in FIG. 3A, when a length of the sheet material is pulled out and measured for sectioning off, the lid of the box often raises along with the sheet material. The cardboard leaf provides no utility in holding the lid down. Moreover, when the lid raises, it interferes with the use of the cardboard leaf to section the sheet material. Therefore, in general commercial usage the lids of commercial sheet material dispensing boxes are often removed by users of these dispensers, leaving the sheet material roll exposed as shown in FIGS. 2A-2C. A plethora of sanitary issues arise in this scenario, not to mention sheet material waste, cumbersome use and storage, and a variety of other drawbacks.

Figure 3B:
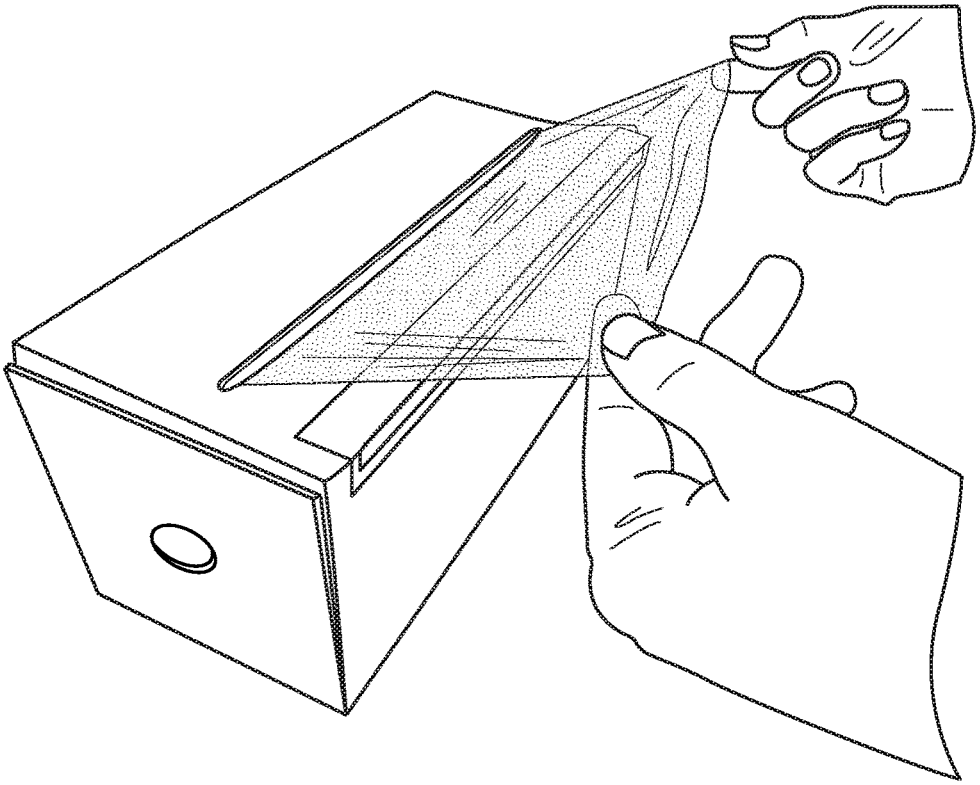
FIG. 3B depicts 3B shows use of a conventional sheet material dispenser with the new exemplary sheet material cutting system.

FIG. 3B depicts the use of an exemplary embodiment of a sheet material cutting apparatus attached with a conventional sheet material dispensing box. As is depicted, the lid of the box is held in position relative to the box (i.e., locked down) such that when a section of sheet material is pulled, the lid of the box does not raise. In comparison with FIG. 3A, which box (in fact, in the Figure it is the very same box) lacks the exemplary sheet material cutting apparatus, the lid can be seen raised out of the box when a section of sheet material is pulled out. Notably, though not depicted, certain often contemplated exemplary sheet material cutting apparatus contemplated herein can be utilized with sheet material dispensing boxes that lack a box top (e.g., after being removed in a commercial setting) since in the most frequently contemplated embodiments the adhesive attachment is provided on the front of the sheet material dispensing box.

FIGS. 4A-4D depict the presently contemplated solutions in additional detail. FIG. 4A depicts a sheet material dispensing box prior to attachment of an exemplary sheet material cutting apparatus. As is depicted, a protective cover is removed from the adhesive strip positioned on the body of the exemplary cutting apparatus to expose the adhesive strip prior to use or attaching it to the sheet material dispensing box. Other attachment means of the cutting apparatus are contemplated herein, including glue, staples, tension application, clips, stakes, sewn attachment, magnetic attachment, etc.

Figure 4B:
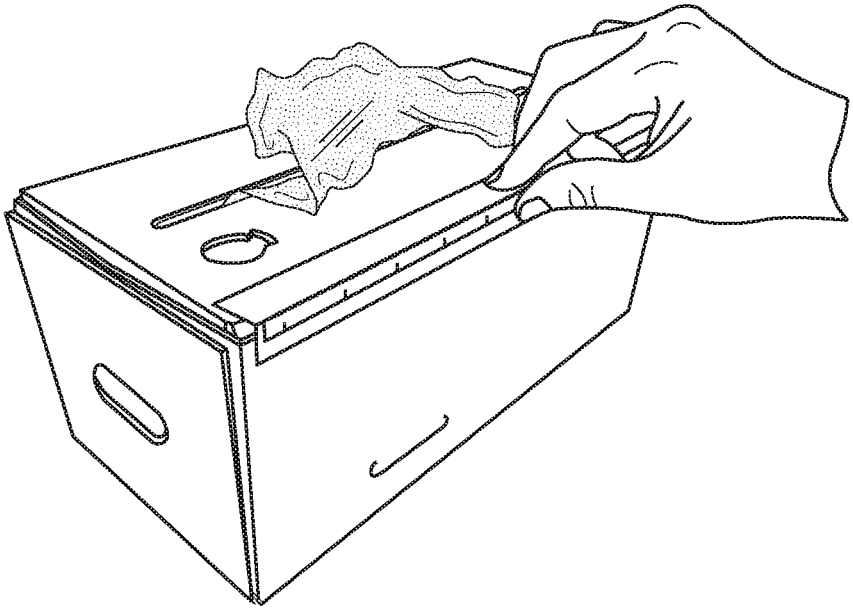

FIG. 4B depicts a sheet material dispensing box during/after attachment of an exemplary cutting apparatus. As is depicted, the adhesive strip of the exemplary cutting apparatus is attached to the front of the sheet material dispensing box.

Figure 4C:
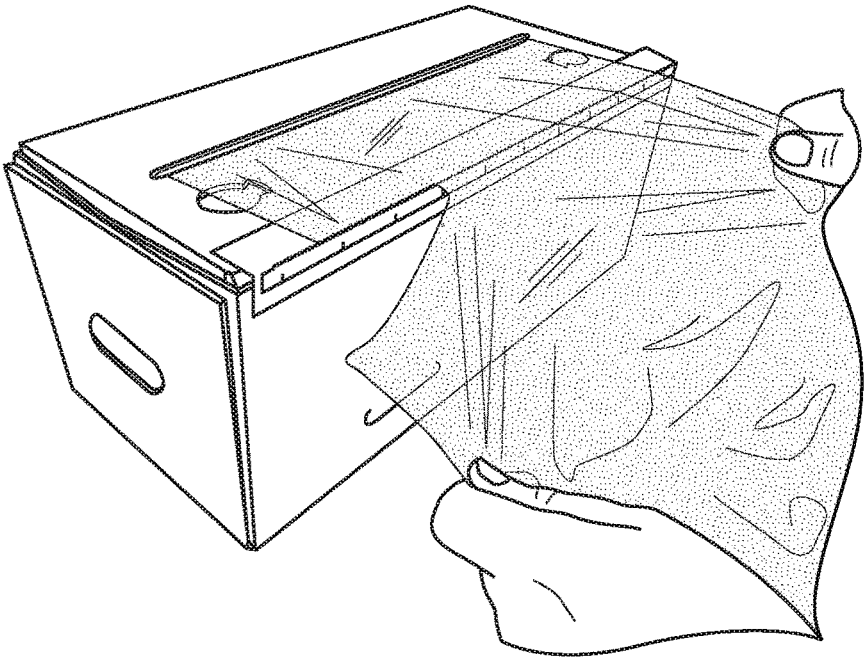

FIG. 4C depicts a sheet material dispensing box including an attached exemplary cutting apparatus while a section of sheet material is being pulled from the roll and prior to being sectioned off on the attached blade.

Figure 4D:
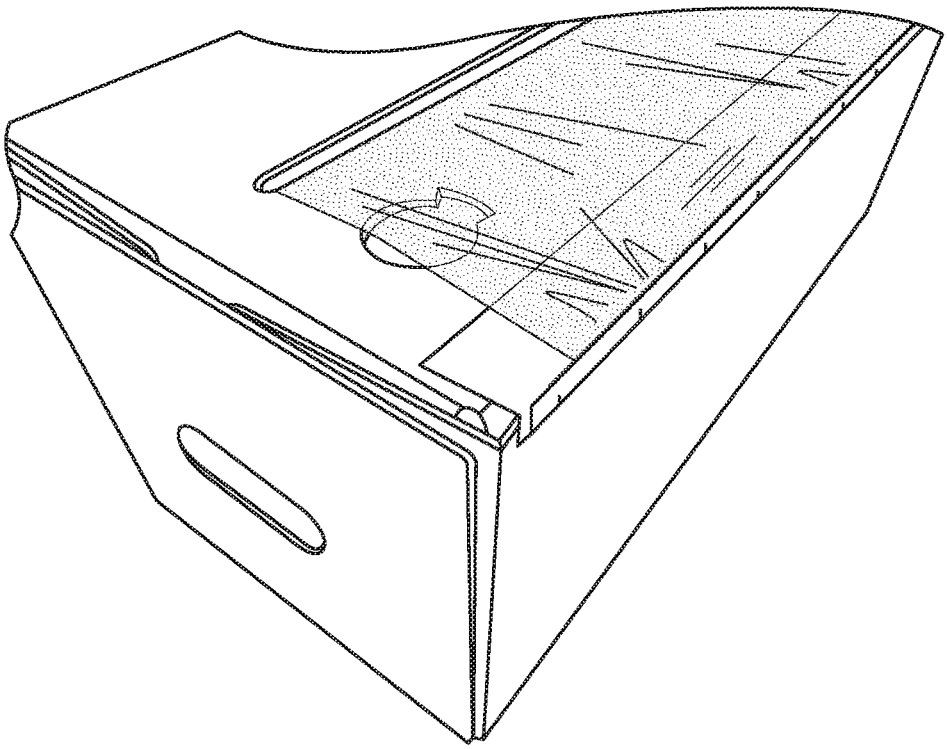

FIG. 4D depicts a sheet material dispensing box including an attached exemplary cutting apparatus after a sectioning off a length of sheet material. As shown, the sheet material—here plastic wrap—can be seen to adhere or cling to the body of the exemplary cutting apparatus in a location immediately adjacent to the blade. Though not wishing to be bound by any particular theory of operation, this adherence either occurs as a result of electrostatic interaction of the plastic sheet material with the plastic material of the body or as result of a secondary coating or element added to the body. This positioning of the end of the plastic sheet material is ideal for one to immediately and repeatedly make use of the presently contemplated cutting apparatus to separate a number of lengths of the sheet material from the roll in a fast, predictable and safe manner with no interference by the box or pulling up of the roll from within the box.

Figure 5A:
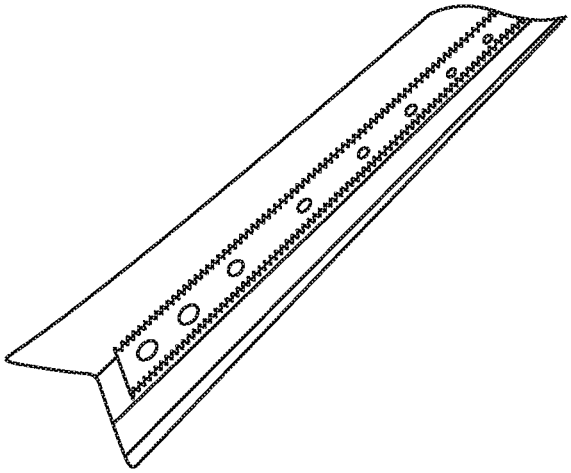
FIGS. 5A and 5B depict different images of an exemplary blade of an exemplary sheet material cutting system contemplated herein.
Figure 5B:
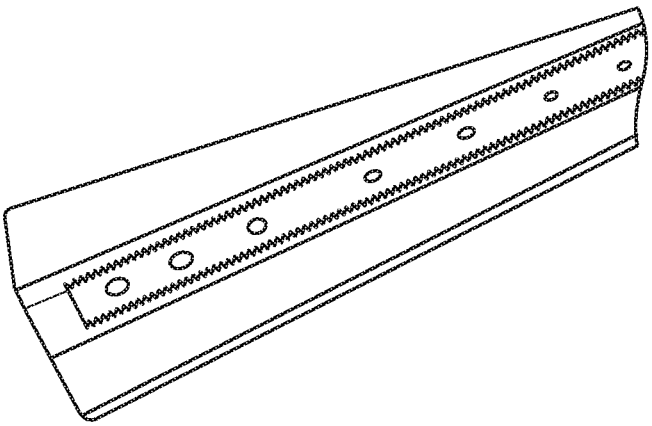
Figure 6:
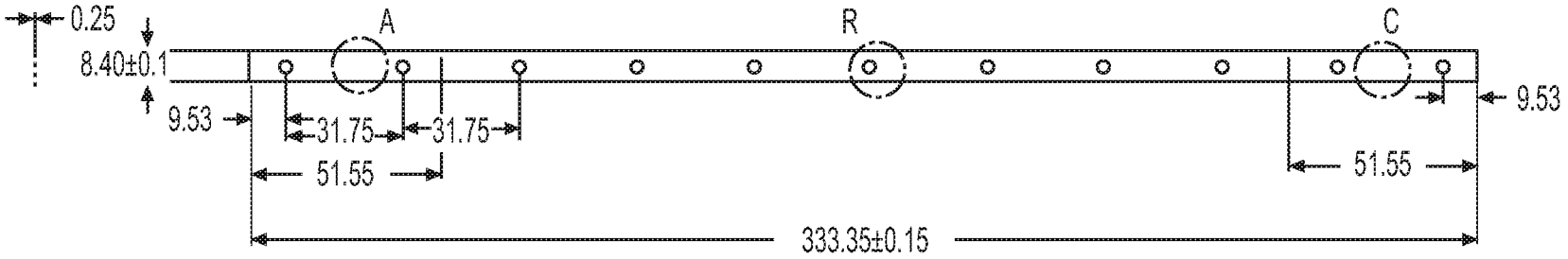
FIG. 6 depicts a top view schematic of an exemplary blade for an exemplary sheet material cutting system contemplated herein.
Figure 7A:
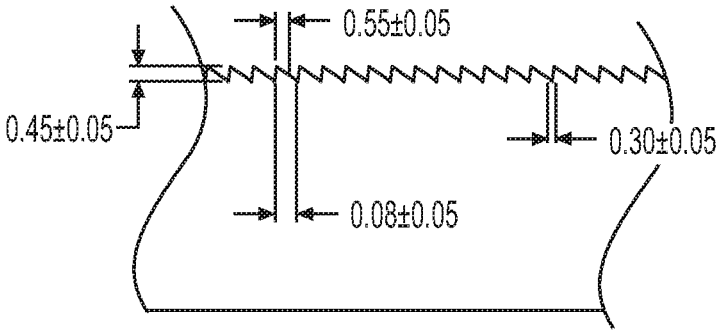
FIGS. 7A-7C depict exemplary tooth arrangements in different sections of one embodiment of an exemplary blade for an exemplary sheet material cutting system described herein.
Figure 7B:
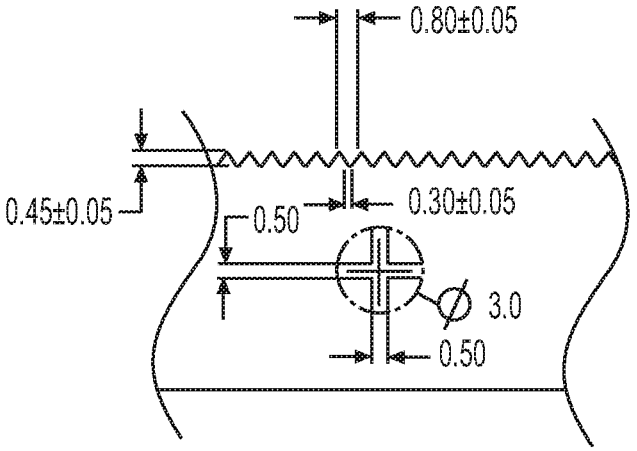
Figure 7C:
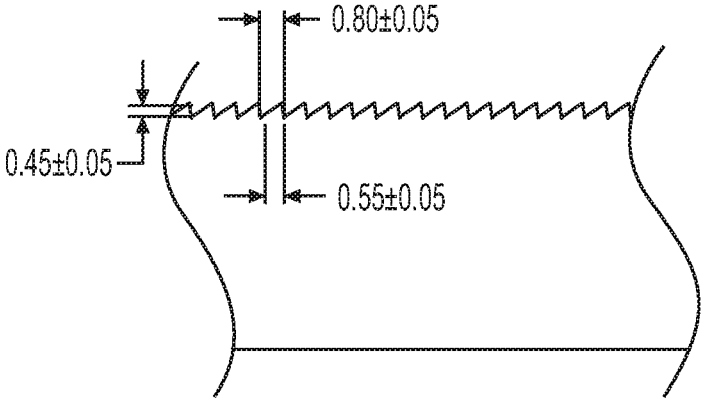

FIGS. 5A and 5B depict the individual views of an exemplary sheet material cutting apparatus, depicting the adhesive strip for attachment to a sheet material dispensing box in addition to the blade. The exemplary cutting apparatus also features a lid lock and a blade that is staked to the body. Staked attachment of the blade is one example of how the blade may be secured to a support, box or other housing, or other aspect of the system. Adhesive, co-molding, coextrusion, thermo form, thermo placing and other known methods are also contemplated as exemplary ways of providing such securement. Otherwise the blade or other cutting portion may be provided along with the body or housing of the cutting system. For example, due to its narrow and elongated profile, the blade is subject to relatively large external forces in use and mechanisms of attachment capable of withstanding such forces are preferred. The blade depicted in these Figures is a specialized blade adapted for safe use in a variety of commercial settings where manual sheet material dispensing and cutting is required. The features of this exemplary blade can be seen in FIGS. 6 and 7A-7C and are described herein. As is depicted in FIG. 6, an exemplary blade includes multiple regions. Each section of the blade often includes a specific tooth arrangement orientation. FIG. 6 depicts three regions, each having a different tooth orientation. FIGS. 7A-7C depict the tooth arrangement and orientation of each of these three regions of FIG. 6. As noted elsewhere herein, multiple cutting systems may be employed on a single sheet material dispenser, for example on the front and back of the dispenser.

Figure 19:
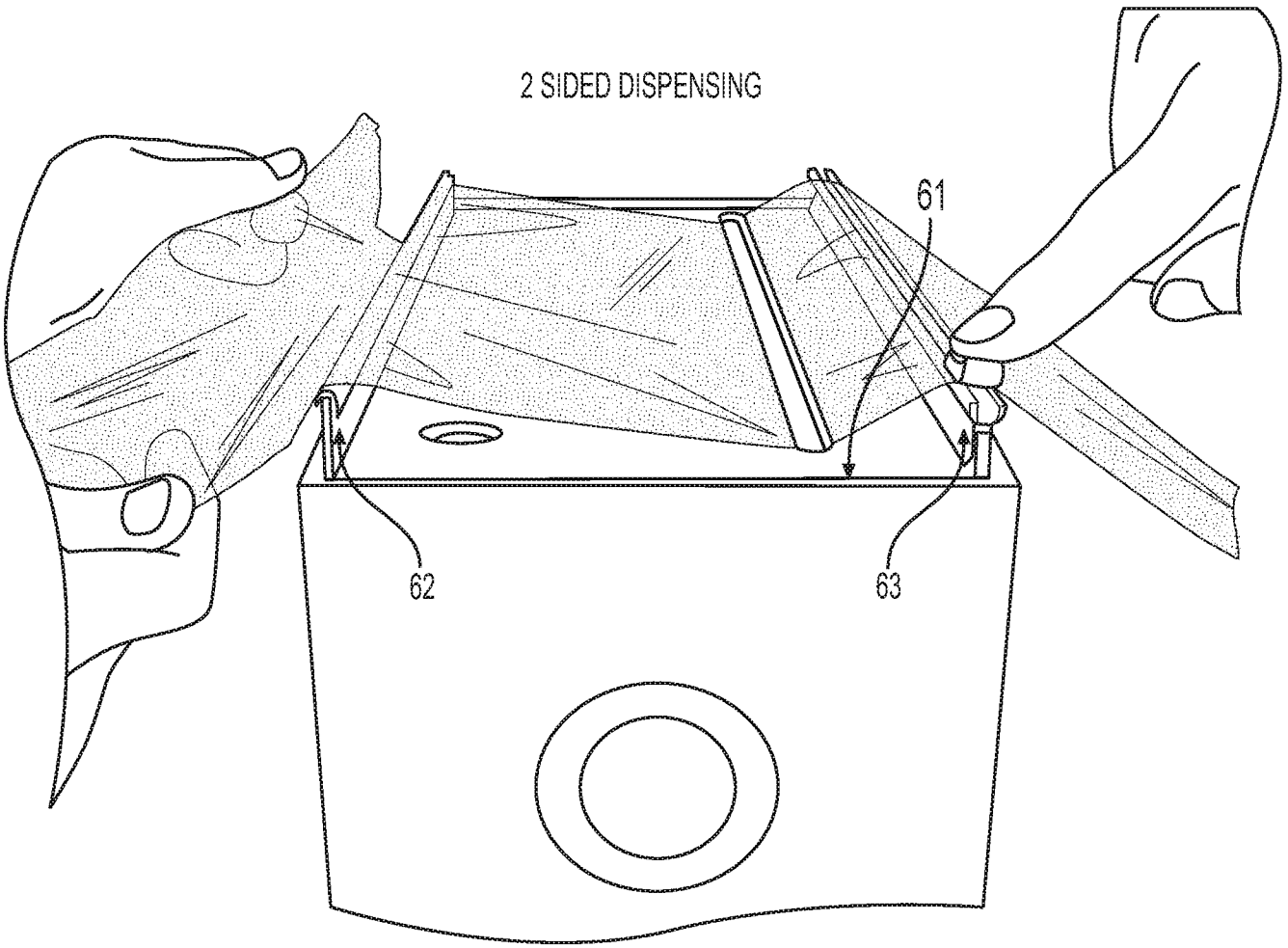
FIG. 19 depicts an exemplary housing for a sheet material cutting system of the present disclosure including two (different) sheet material cutting portions inserted in operable connection with the housing permitting 2 sided dispense of sheet material dispense. Both slide and blade cutting portions are depicted, though either or both could be any exemplary sheet material cutting portion contemplated herein.

When placing the cutting system on the back of the dispenser as a solitary cutting system that includes a lid lock portion, often the lid lock portion is provided with a longer dimension to extend further over the top of the dispenser to increase the leverage over the top. In certain embodiments, the sheet material cutting system employs a lid lock portion over the top of the dispenser, extending between the front and the back of the dispenser and having an opening to permit the sheet material to pass through (not depicted). In such embodiments, the lid lock portion may be a solitary or contiguous piece of material or comprised of multiple pieces. Also, in such embodiments the lid lock portion may be provided as top of the sheet material dispenser or covering over a box or other housing for a sheet material. Such embodiments may often employ multiple cutting mechanisms, for example, one for the front of the dispenser and/or one/another for the back of the dispenser. FIG. 19 provides a depiction of such an embodiment.

The teeth of the blade are adapted to provide a safer blade surface for human use versus conventional blades due to their small size and compact arrangement. From a basic standpoint, the blade (or teeth thereof) extends outwardly from a support such that the blade be contacted by a sheet material to be able to cut the material without another aspect of the support of a box or other housing interfering with the cut. As is seen in FIG. 7A, the teeth in this region are arranged with a sloping side (right) and a vertical side (left) meeting at an apex above the blade body. This region represents the left section of the blade of FIG. 6. As is seen in FIG. 7B, the teeth in this region are arranged with two sloping sides meeting at an apex above the blade body. This region represents the middle section of the blade of FIG. 6. As is seen in FIG. 7C, the teeth in this region are arranged with a sloping side (left) and a vertical side (right) meeting at an apex above the blade body. This region represents the right section of the blade of FIG. 6. While the height of the teeth of the blade (e.g., in each exemplary region) are measured at 0.55 mm, or between 0.40 mm to 0.50 mm, it may vary slightly from this range without departing from the presently contemplated embodiments. While the distance between the apex of each tooth on the exemplary blade is measured at 0.80 mm, or between 0.75 mm to 0.85 mm, it may vary slightly from this range without departing from the presently contemplated embodiments.

The different tooth arrangements in each of the three sections are provided for a variety of purposes of separating a length of sheet material from a roll using multiple different techniques. For example, one could tear from left to right; one could tear from right to left; one could press first in the center of the sheet material cutting the center portion first and apply pressure outwardly to the edge of the sheet material; or simply pull the whole sheet evenly down across the blade. The depicted tooth arrangement permits rapid and safe sheet material cutting by providing sufficient tooth height, apex positioning, and tooth geometries to penetrate the plastic material at an angle to avoid having the sheet material slip from (or across) the teeth after contact, regardless of the direction in which pressure is applied. Importantly, such utility is provided while protecting the user from injury.

FIGS. 8A-8D depict another exemplary embodiment of a sheet material cutting system of the present disclosure. The depicted embodiment includes a clip-on attachment sized and situated to securely attach to a wall of the sheet material dispenser or a sheet material dispenser insert. The two vertically arranged legs (10, 10*a*) are provided such that the distance between the legs (D) corresponds with the width of a s of a sheet material dispenser. Often, the width "D" is measured by the shortest distance between legs 10 and 10*a* in embodiments that include an angled relative orientation of these legs. Such spring-like angulation creates a clip type of arrangement that is angled when not clipped onto a sheet material dispenser or insert, and parallel or close to parallel in orientation when clipped onto a sheet material dispenser or insert. In certain embodiments, legs 10 and/or 10*a* are parallel or opposite angled relative to one-another but include one or more clip piece (not depicted) that extends into the area occupied by distance D. In frequent of the contemplated embodiments, the legs 10 and 10*a* and as, for example, a spring-loaded clip that provides a secure attachment of the system or body of the system to the sheet material dispenser through lateral force. In certain embodiments, legs 10 and/or 10*a* include a portion that pierces the material of the sheet material dispenser or insert to enhance the secure attachment of the body.

Figure 8A:
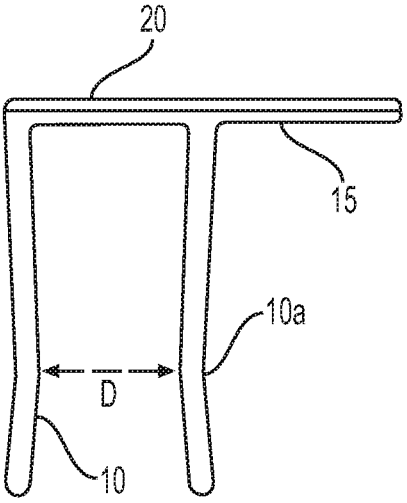
FIGS. 8A-8D depict an exemplary body of an exemplary sheet material cutting system, including an attachment portion, a lid lock portion and a sheet material cling portion.
Figure 8B:
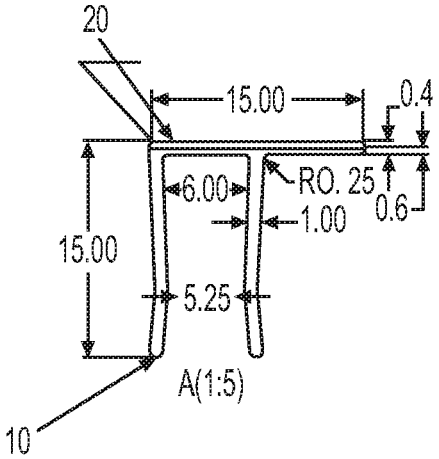
Figure 8C:
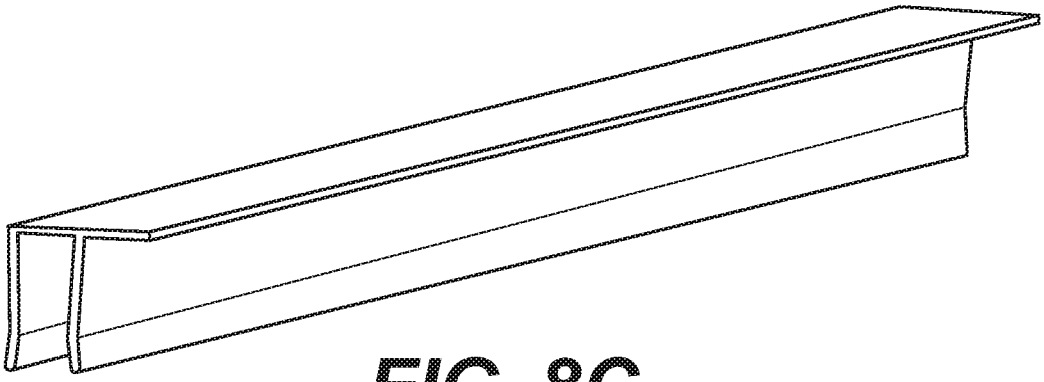
Figure 8D:
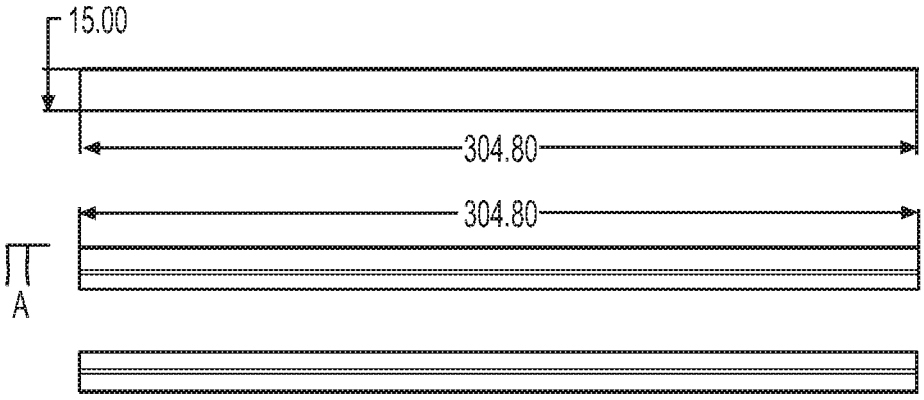
Figure 9A:
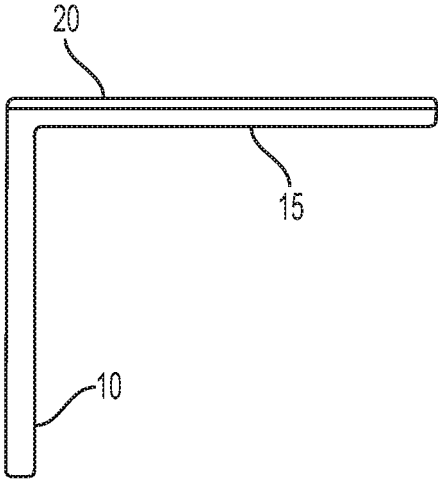
FIGS. 9A-9D depict an exemplary body of an exemplary sheet material cutting system, including an attachment portion with adhesive that is not shown, a lid lock portion and a sheet material cling portion.
Figure 9B:
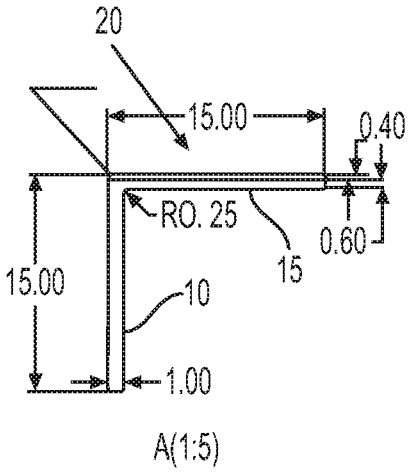
Figure 9C:
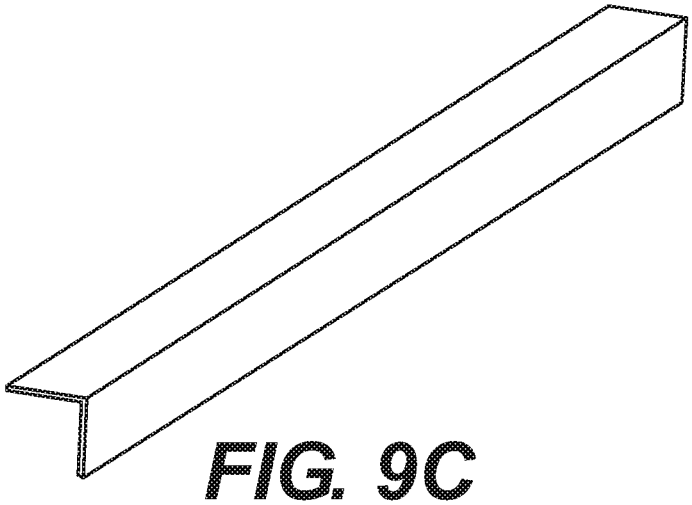
Figure 9D:
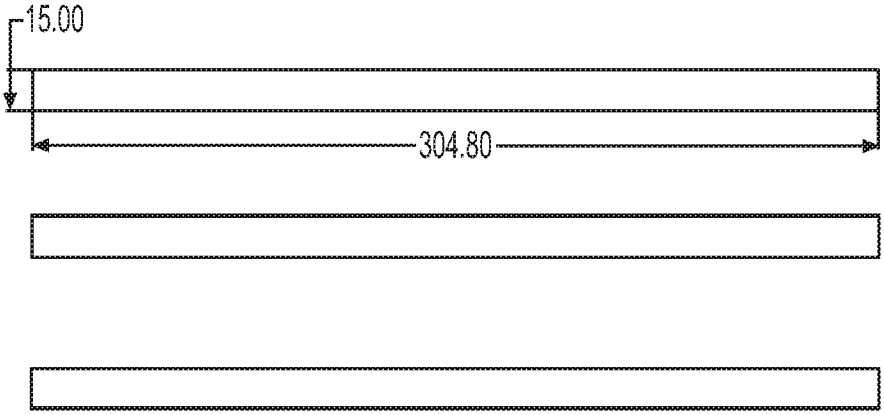

As is depicted in FIGS. 8A-8C, lid lock portion 15 is situated at the distal ends of legs (10, 10*a*) and includes a sheet material cling portion 20. The sheet material cling portion 20 is applied across the lid lock portion distal surface in the depicted embodiment, but it is contemplated that the sheet material cling portion occupies less than the full area of the lid lock portion 15. Sheet material cling portion 20 and lid lock portion 15 in certain embodiments are co-extruded. In certain other embodiments, the sheet material cling portion 20 is added to the lid lock portion. The sheet material cutting portion is not depicted in FIG. 8, but in practice is included attached to leg 10 or at or near the intersection of leg 10 and lid lock portion 15. Exemplary orientations of the sheet material cutting portion relative to the body, legs and lid lock portion are depicted in FIGS. 9-13.

An exemplary sheet material cutting portion contemplated herein in each of the embodiments is most frequently a blade such as a metal blade or a plastic blade, an abrasive surface, a slide cutter, a defined protrusion or series thereof, an intersection of surfaces or materials, abrupt end of a material, or the like. Often when a blade is incorporated or used in or as sheet material cutting portion, the blade has a serrated surface including one or more teeth. Flat blades are also contemplated.

FIGS. 9A-9D depict another exemplary embodiment of the sheet material cutting systems of the present disclosure similar in physical arrangement to the embodiment of FIGS. 5A & 5B. The depicted embodiment utilizes leg 10 as the attachment portion, which is attached to a sheet material dispenser via an attachment mechanism such as adhesive, one or more clips, stakes, or the like (not depicted) to securely attach to a wall of the sheet material dispenser or a sheet material dispenser insert. Lid lock portion 15 is situated on top of the leg/attachment portion 10 and includes a sheet material cling portion 20. The sheet material cutting portion is not depicted in this figure, but in practice is included attached to leg 10 or at or near the intersection of leg/attachment portion 10 and lid lock portion 15.

Figure 10A:
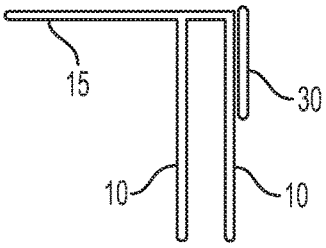
FIGS. 10A-10M depict a variety of adaptations of the various aspects of the exemplary sheet material cutting systems described herein.
Figure 10B:
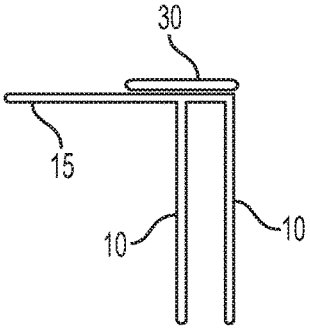
Figure 10C:
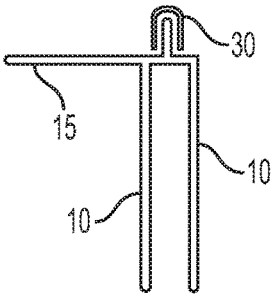
Figure 10D:
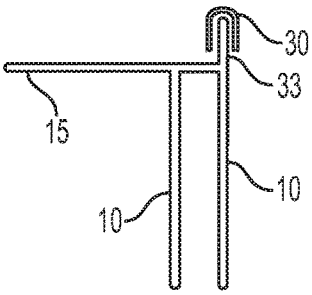
Figure 10E:
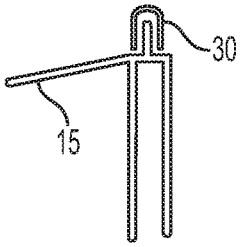
Figure 10F:
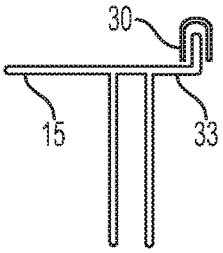
Figure 10G:
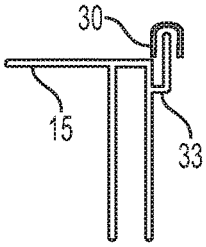
Figure 10H:
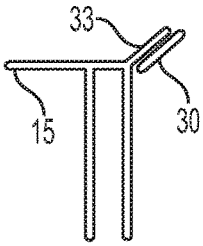
Figure 10I:
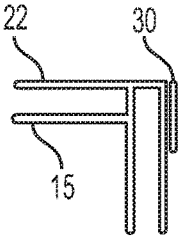
Figure 10J:
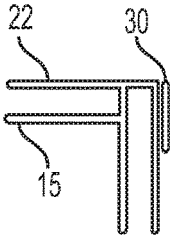
Figure 10K:
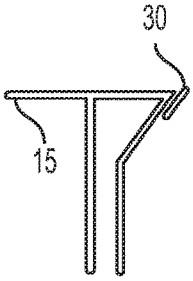
Figure 10L:
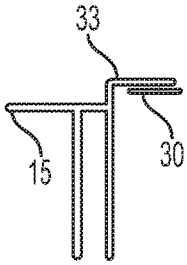
Figure 10M:
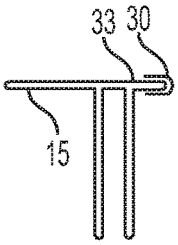

FIGS. 10A-10M depict various adaptations of the embodiment of FIG. 8 for clip-on attachment to the sheet material dispenser. Sheet material cutting portion 30 is depicted in various arrangements relative to the body. In multiple of the arrangements, a sheet material cutting extension portion 33 is included to position the sheet material cutting portion 30 at a predetermined location relative to the leg/attachment portion 10 and the lid lock portion of the system. Such predetermined positions are often provided to enhance, improve or change the cutting characteristics of the system. In certain embodiments, the cutting extension 33 is manipulatable such that its position may be adjusted before, during, or after placement on a sheet material dispenser. In such embodiments, the cutting extension 33 is moved from one orientation to one or more different physical orientations relative to the leg/attachment portion 10 and/or lid lock portion 15. The depicted embodiments include multiple adaptations of the cutting portion 30 such as a wrap-around or detachable cutting portion 30 or a blade for description purposes only and are not intended to be limiting. Any of the cutting portions 30 contemplated herein may be utilized with the depicted embodiments of FIGS. 10A-10M. FIGS. 101 and 10J include a raised sheet material cling portion 22. This portion may include the sheet material cling adaptations discussed in connection with FIG. 8. The relative orientation of the sheet material cling portion 22 can be adapted to have a physical orientation that enhances the cling of a sheet material both pre and post cut and/or enhance the ability of the user to safely locate and pull the end of the sheet material to measure for sectioning off another length of the sheet material. Such a physical orientation may often be an angle greater than horizontal, for example as depicted in FIGS. 11B, 11G, 11H and 11I (among others) for ease of grabbing and cutting. When a blade is present, it is typically oriented in a position such that the portion of the bladed intended for sectioning a sheet material is accessible by the sheet material. In application this most frequently orients the portion of the bladed intended for sectioning a sheet material extending outwardly from at least a portion of the lid lock portion, other blade support, other sheet material cutting portions, or housing portion.

While leg/attachment portion 10 is depicted as two individual lines in FIGS. 10A-10M, it is understood that these embodiments contemplated leg/attachment portion 10 as a single support or two or more supports. In certain embodiments, the leg/attachment portion 10 is the same or different material as the cutting portion 30. In certain embodiments, the leg/attachment portion 10 is comprised of cardboard, metal, ceramic, plastic, wood, corrugated plastic, or a combination of two or more of the foregoing.

FIGS. 11A-11K depict various adaptations of the embodiments of FIGS. 8 and 9 for clip-on attachment or other securement to the sheet material dispenser. Sheet material cutting portion 30 is depicted in various arrangements relative to the body. In multiple of the arrangements, a sheet material cutting extension portion 33 is included to position the sheet material cutting portion 30 at a predetermined location relative to the rest of the leg/attachment portion 10 and the lid lock portion 15 of the system. Such predetermined positions are often provided to enhance, improve or change the cutting characteristics of the system. In certain embodiments, the cutting extension is manipulatable such that its position may be adjusted before, during, or after placement on a sheet material dispenser. In such embodiments, the cutting extension is moved from one orientation to one or more different physical orientations relative to the attachment portion and/or lid lock portion. The depicted embodiments include multiple adaptations of the cutting portion 30 such as a wrap-around or detachable cutting portion or a blade for description purposes only and are not intended to be limiting. Any of the cutting portions contemplated herein may be utilized with the depicted embodiments of FIGS. 11A-11K.

Figure 11A:
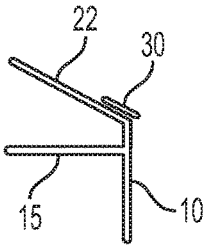
FIGS. 11A-11K depict another variety of adaptations of the various aspects of the exemplary sheet material cutting systems described herein.
Figure 11B:
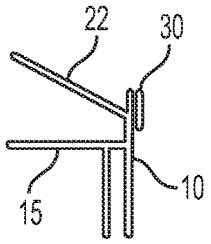
Figure 11C:
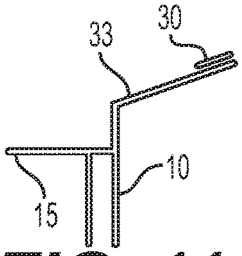
Figure 11D:
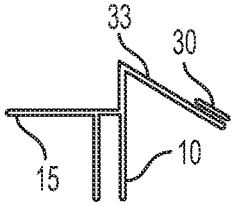
Figure 11E:
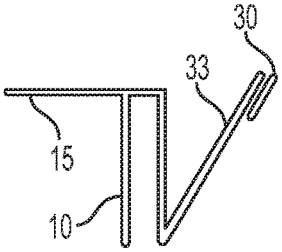
Figure 11F:
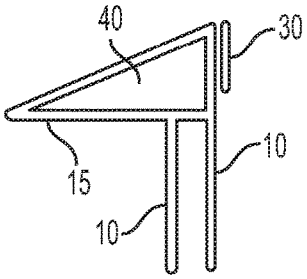
Figure 11G:
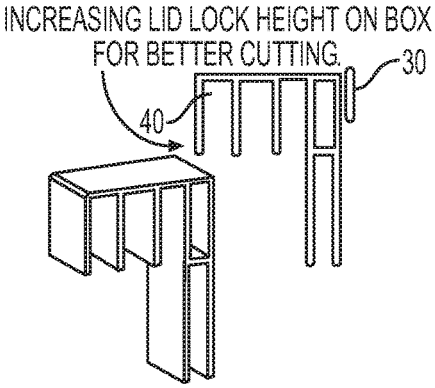
Figure 11H:
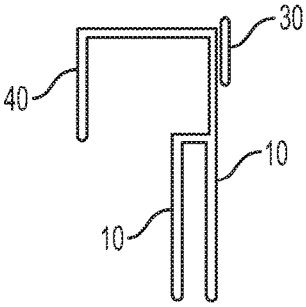
Figure 11I:
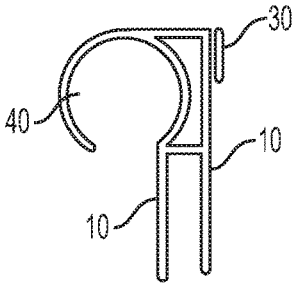

In FIGS. 11G-11I, the system includes a raised portion 40 that positions the sheet material cutting portion 30 and the body of the lid lock portion above the lid of the sheet material dispenser for enhanced ease of sheet material cutting. This positioning of the lid lock portion would also elevate the sheet material cling portion at the level of the top of the lid lock portion. The sheet material cling portion may include the sheet material cling adaptations discussed in connection with FIG. 8. The relative orientation of the sheet material cling portion in FIGS. 11A-11K, similar to FIGS. 10A-10M, can be adapted to have a physical orientation that enhances the cling of a sheet material both pre and post cut and/or enhance the ability of the user to safely locate and pull the end of the sheet material to measure for sectioning off another length of the sheet material.

Figure 11J:
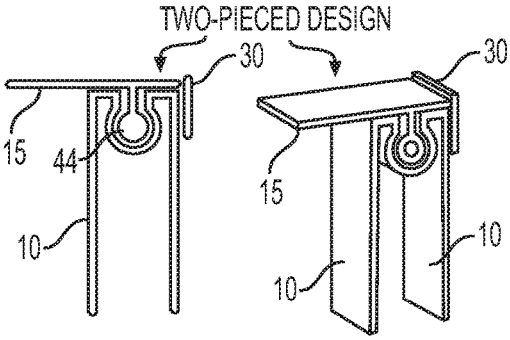
Figure 11K:
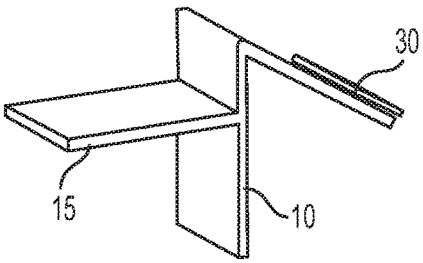

As depicted in FIG. 11J, two-piece adaptations of the system are also contemplated, which permits the attachment of the body to the sheet material dispenser and a secondary attachment of the sheet material cutting portion, lid lock portion and cling portion. A snap-fit attachment 44 is depicted, though the depictions are not intended to be limiting and the physical arrangement may vary based on application. Such arrangements are often beneficial for sheet material dispensers that accept multiple rolls of sheet material. In these and other cases the sheet material cutting portion can be removed and replaced, including the ability to integrate two or more different types of sheet material cutting portions. In certain examples the type of sheet material integrated in the sheet material dispenser is changed from a first material to a second different material and the cutting portion is correspondingly changed from being optimal for cutting of the first material to, after replacement, providing optimal cutting of the second different material. Also, the two-piece adaptations are also useful for including other adaptations that are beneficial for the end-use of the sheet material dispenser. For example, in certain settings the sheet material dispenser may be used in a setting that defines or limits the access to the sheet material, affecting the angle that it is accessed and pulled for use. In such settings the two-piece adaptation could provide for an adaptation of the sheet material cling portion to impart optimal sheet material cling at the planned use angle and safe sheet material end access properties relative to the cutting portion.

Figure 12A:
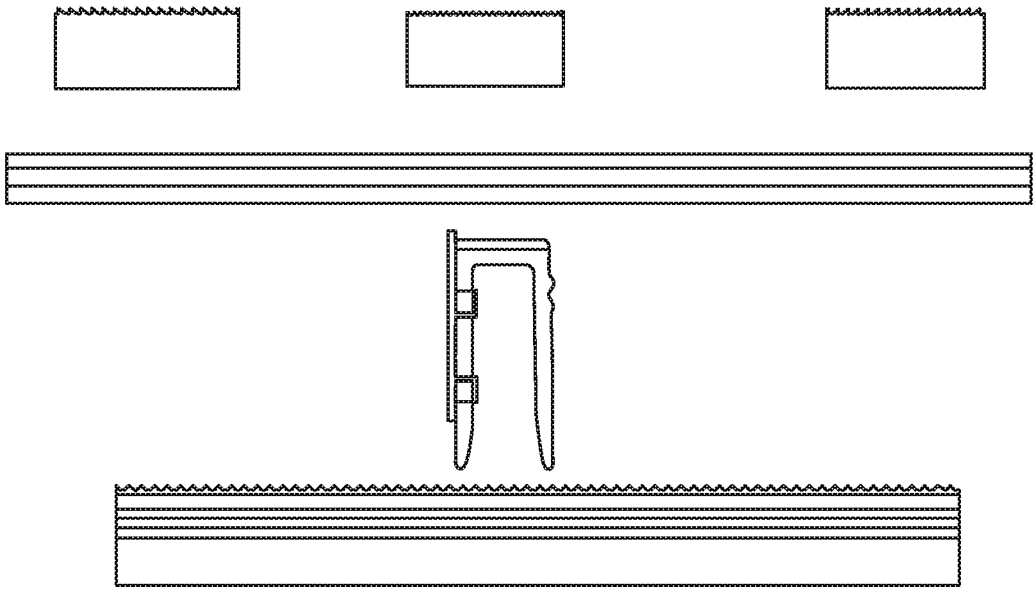
FIGS. 12A-12B depict another exemplary body of an exemplary sheet material cutting system, including a sheet material cutting portion, an attachment portion, and a sheet material cling portion.
Figure 12B:
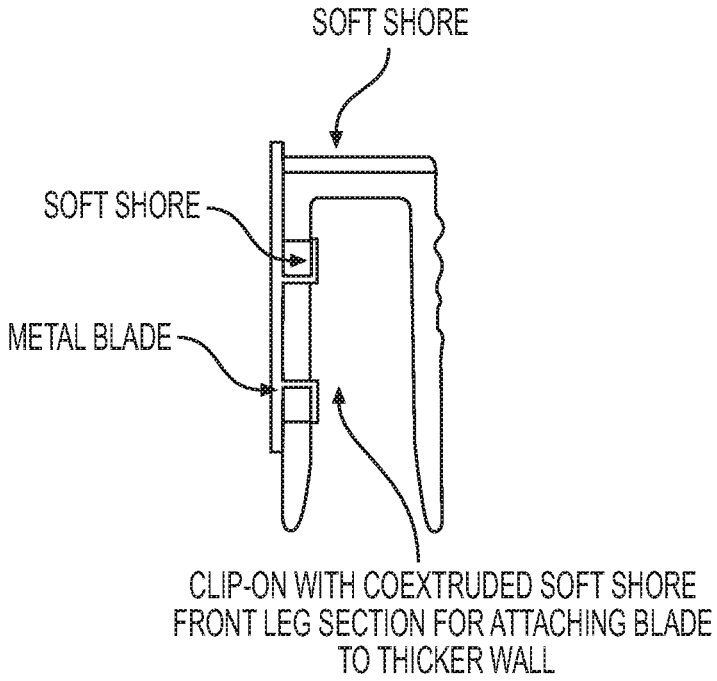

FIGS. 12A-12B depict another adaptation of the contemplated embodiments that can be adapted to the embodiments of FIGS. 8-11 and other embodiments contemplated herein. FIGS. 12A-12B are provided, for example, to show another attachment of the sheet material cutting portion to the leg of the body. The depicted example would in practice often be adapted to include a lid lock portion, either co-formed with or attached to the attachment portion. In certain embodiments, the lid lock portion is provided using a separate locking mechanism such as a male/female clip (or more) that secures the lid in the sheet material dispenser. Thus, presently contemplated systems may be provided in more than a single piece, often with the sheet material cutting portion, attachment portion and sheet material cling portions on one integrated cutting component and a lid lock mechanism provided by a separate lid locking component (or plurality of components) that work(s) in concert with the integrated cutting component. As noted herein, although staked attachment is depicted, adhesive, co-molding, coextrusion, thermo form and other known methods are also contemplated as exemplary ways of securing a blade or sheet material cutting portion to the body of the sheet material cutting system, or otherwise providing the blade or other cutting portion along with the body of the cutting system.

Figure 13:
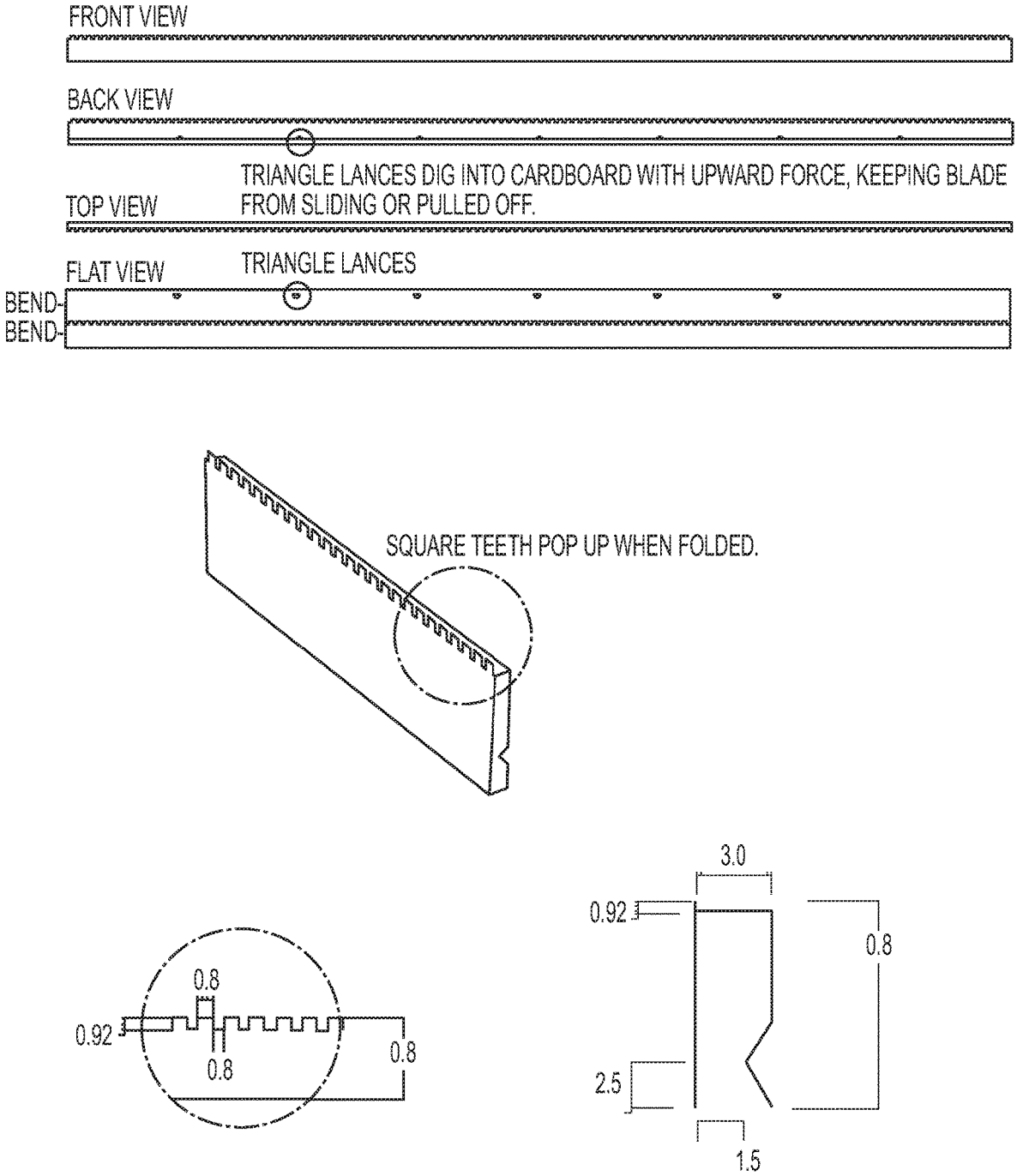
FIG. 13 depict different images of an exemplary blade of an exemplary sheet material cutting system alone and together with an attachment portion.
Figure 14:
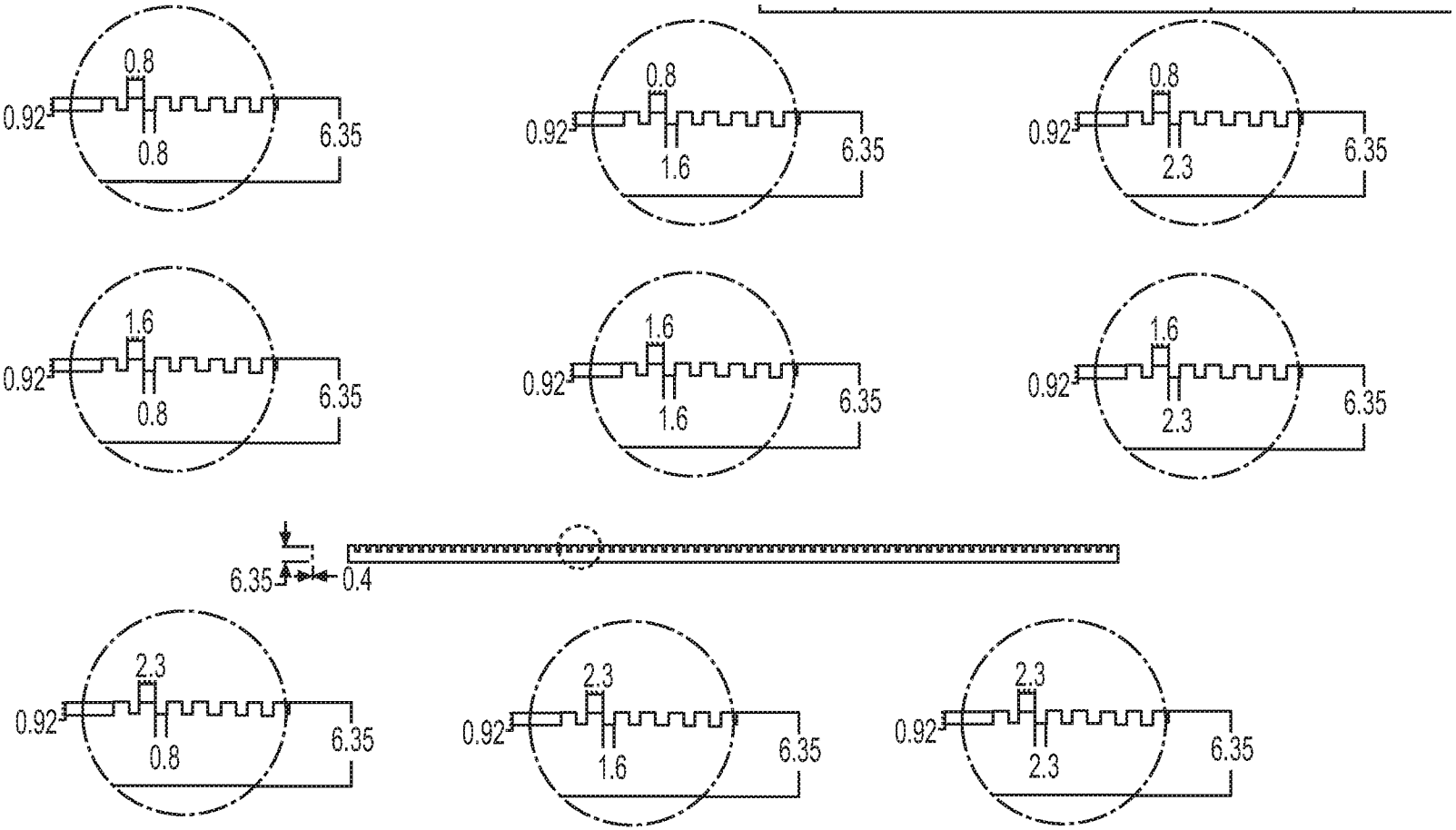
FIG. 14 depict different images of cutting teeth examples of an exemplary blade of an exemplary sheet material cutting system.

FIGS. 13-14 depict a blade including square-shaped teeth as the sheet material cutting portion. Such an embodiment provided enhanced safety for the user of the embodiments contemplated herein. This blade can be used in connection with the sheet material cutting system embodiments of the present disclosure. FIG. 13 depicts an attachment portion along with the blade. Similar to the embodiment of FIG. 12, the depicted examples would often in practice often include, or be adapted to include, a lid lock portion as contemplated herein. FIG. 13 depicts an all metal cutting portion along with an all metal attachment portion, which all metal adaptation could be utilized for any embodiment contemplated herein. With regard to the square-shaped teeth, the width of the teeth, the spacing between the teeth, and the height of the teeth may be adapted to enhance cutting, depending on the type of sheet material intended to be cut. For example, increasing gap size between teeth would effectively make the square-shaped teeth cutting portion sharper.

Figure 15A:
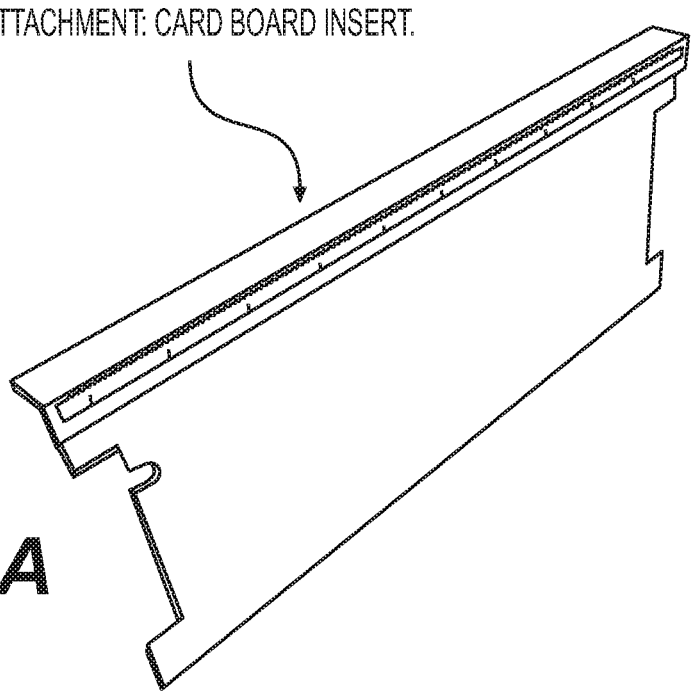
FIG. 15A depicts the attachment of an exemplary sheet material cutting system to an insert for a sheet material dispenser which would be inserted inside of the dispenser box instead on the front of the box.
Figure 15B:
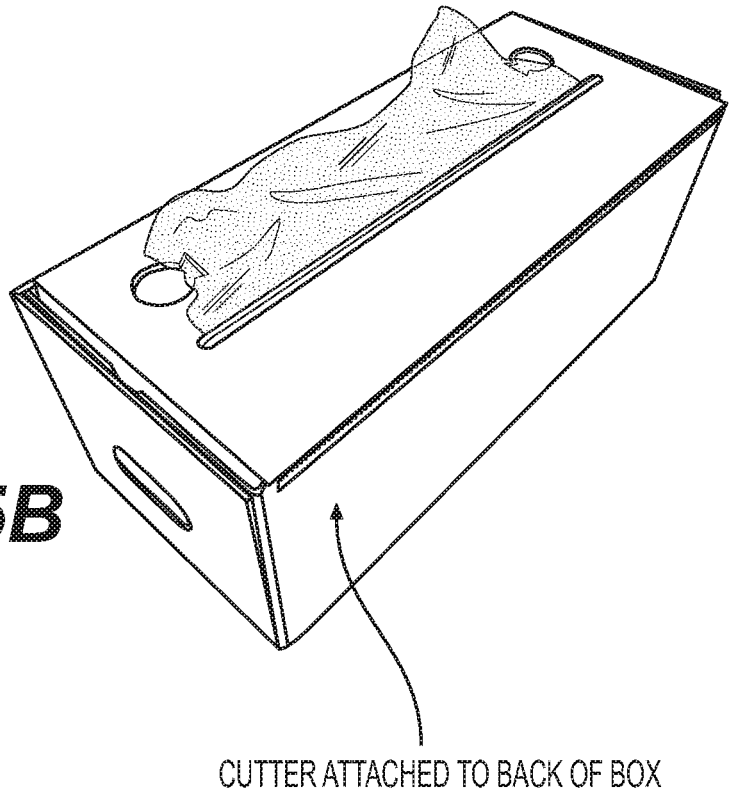
FIG. 15B depicts the exemplary sheet material cutting system attached to the back of the box to provide a secondary cutting direction which would, for example, allow cutting on the back or to permit the box to be used by two operators. In this scenario an exemplary set up would involve attaching the exemplary cutting system to the front and back of the box to ensure the lid is held in place. Though attachment only on the back of the box is contemplated herein and may often be employed in a manner that holds down the lid of the sheet material dispenser.
Figure 16:
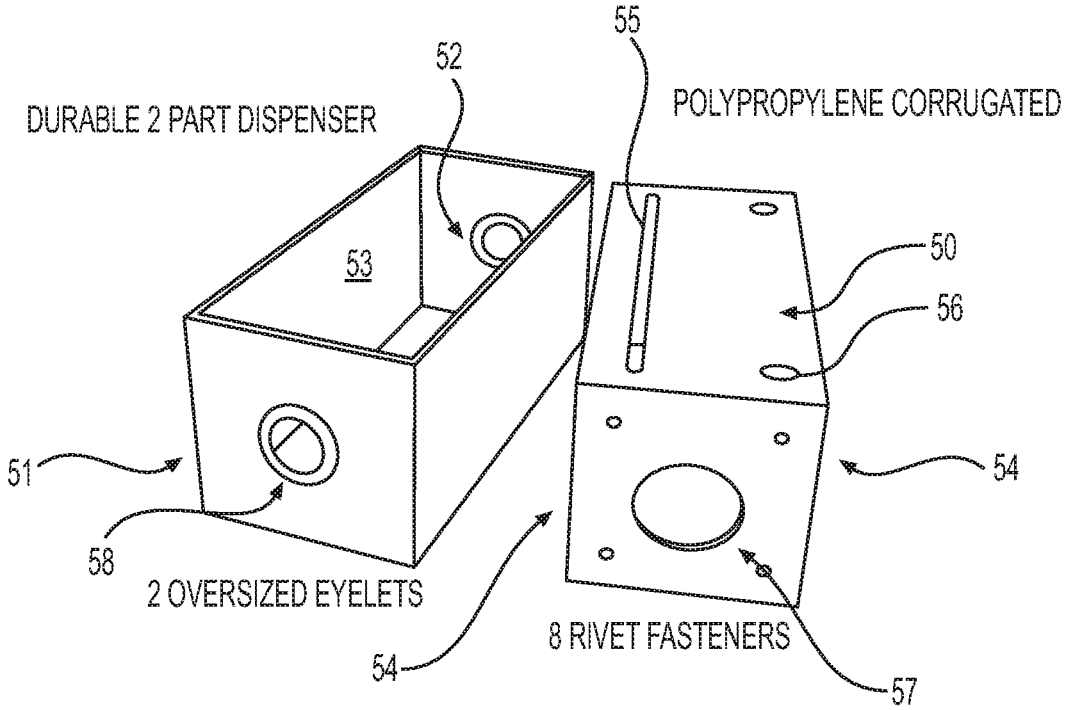
FIG. 16 depicts a view of an unassembled exemplary housing for a sheet material cutting system of the present disclosure.
Figure 17:
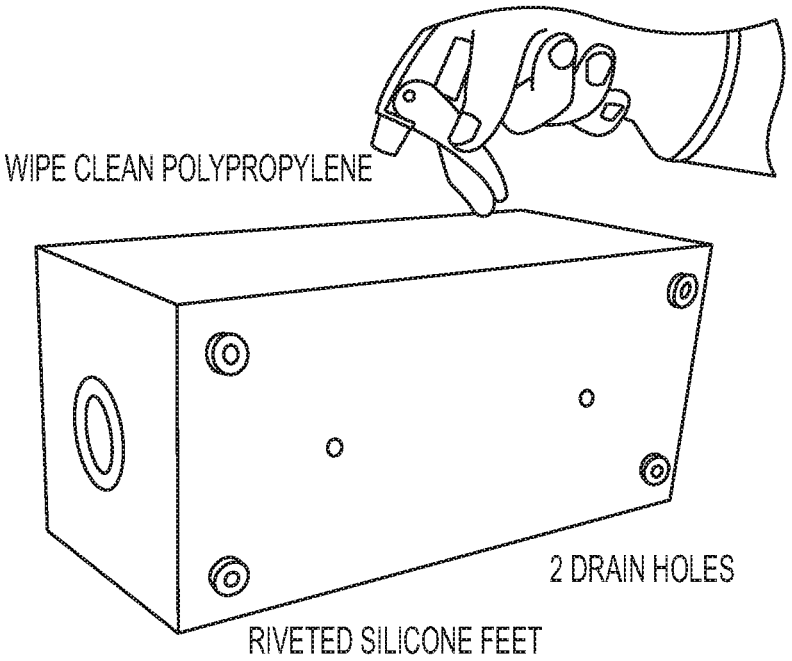
FIG. 17 depicts another view of an exemplary housing for a sheet material cutting system of the present disclosure.

FIGS. 15A and 15B depict the attachment of an exemplary sheet material cutting system to an insert for a sheet material dispenser (FIG. 15A), and alternatively attachment to the sheet material dispenser on what would be considered the back of the sheet material dispenser (FIG. 15B). Thus, the present systems may in certain embodiments have effective alternative placement locations on the sheet material dispenser.

FIGS. 16-19 depict another embodiment of the presently contemplated sheet material dispense and/or cutting systems. In the Figures a housing is depicted comprised of upper 50 and lower 51 portions configured to fit together. When fit together, the upper 50 and lower 51 portions define an open chamber area 52. Open chamber area 52 is configured to accept a sheet material roll 60. The housing adapted in a variety of configurations and the various aspects of the configuration shown in FIGS. 16-19 are merely exemplary. In this embodiment, the upper 50 portion is configured to be slidably accepted entirely within in lower 51 portion of the housing. In adapting the housing in this manner, the lower portion is dimensionally configured to match the upper portion, and vice versa, to create a nested housing with one portion nested inside of the other portion and defining an open chamber area 52 inside the housing walls 53, 54. The outside of the upper portion housing walls 54 are adapted to be adjacent the inside of lower portion walls 53 when the upper portion is positioned within the lower portion. These walls are more or less contiguous and parallel with each other with the shape of the upper portion 50 matching, and in this embodiment being a mirror image of, the lower portion 51 in terms of general shape, while each of the upper and lower portions contain specialized aspects for accomplishing the film dispensed purpose of the system.

Positioned in the upper portion is a sheet material passage 55 adapted to permit a sheet material to pass from the interior open chamber area 52 to the outside of the housing when the system is assembled with the upper and lower portions. The upper portion also includes openings 56 that can be adapted for finger holds to permit ease of opening and closing (i.e., putting together or separating) the nested housing portions. Also, the upper portion in certain embodiments includes an upper portion eyelet 57 that matches the lower portion eyelet 58 on the lower portion with the eyelets aligning with one-another when the upper portion is nested within the lower portion (i.e., when the system is assembled).

While the system depicted in FIGS. 16-19 is shown with the upper portion fitting inside of the lower portion, the system is equally contemplated such that the upper portion fits over the outside of the lower portion. Nevertheless, there are a variety of advantages to configuring the system in the manner depicted in FIGS. 16-19.

Figure 18B:
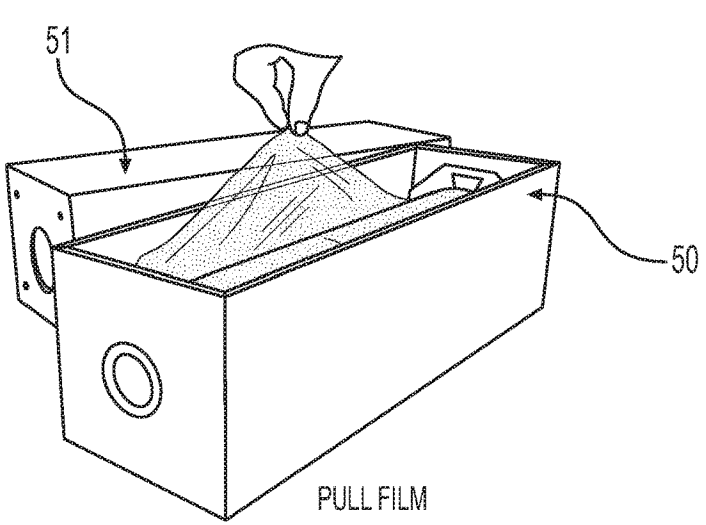
FIGS. 18A-18D depicts an exemplary assembly order of operations for an exemplary housing and sheet material cutting portion in connection with sheet material.
Figure 18D:
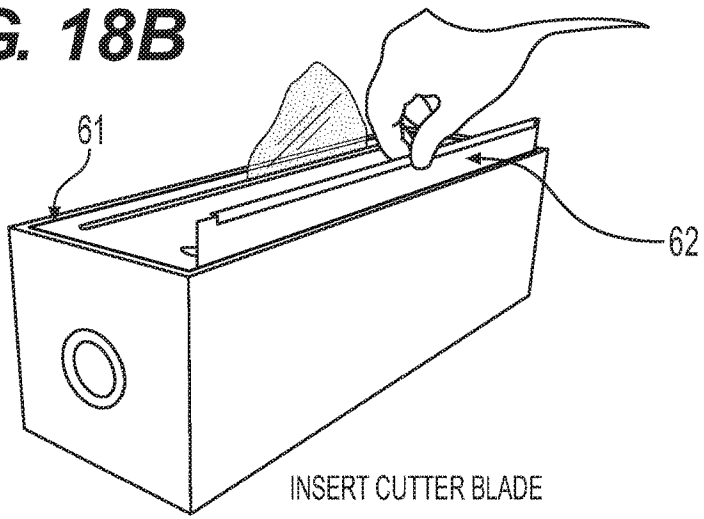
Figure 18A:
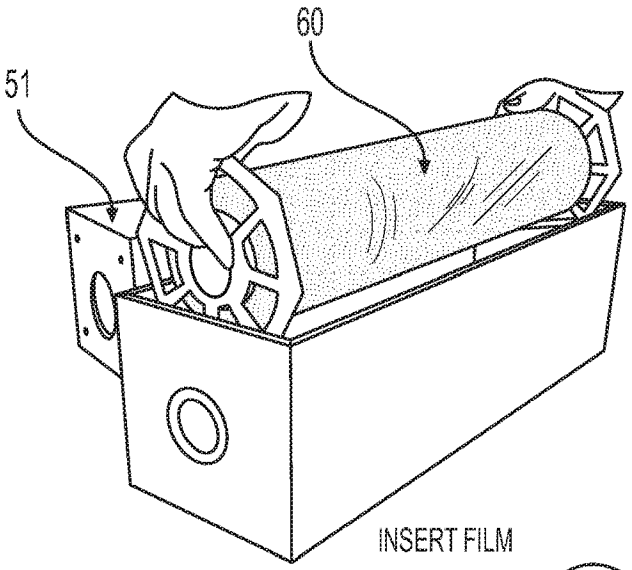
Figure 18C:
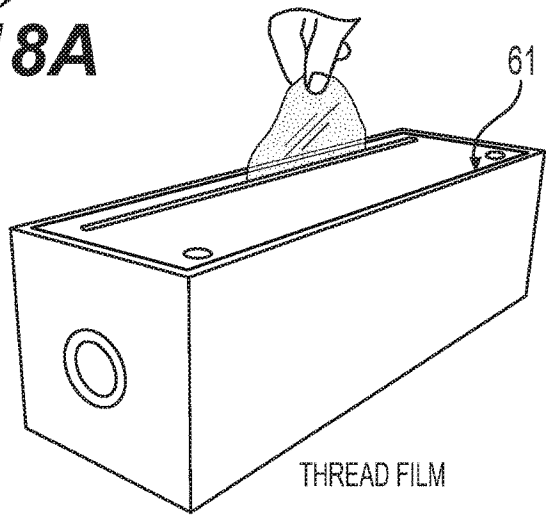

For example, when the upper portion is nested within the lower portion, a boundary gap 61 exists that is the area between the outside of the upper portion housing walls 54 and the inside of lower portion walls 53. This boundary gap 61 is a part of the present systems utilizing two housing portions that nest together. As depicted in FIG. 18D, a sheet material cutting portion is positioned on, or as part of, an insert or support (together, 62) in a manner similar in form, though the specific design of the support or cutter blade may vary according to the description and embodiments described herein, to that depicted in FIG. 1A, 13, or 15A. This cutting portion with a support 62 is configured with a length and width such that it can be inserted into the boundary gap 61 between the upper portion and the lower portion of the housing. Generally, this positioning is done along the longer side of the housing since that is generally the easiest way to dispense and cut a sheet material dispensed from the open chamber area 52 of the housing. But, in certain embodiments, a cutting portion with a support 62 is adapted to have a length and width to be positioned in the boundary gap 61 on the shorter side of the housing.

The present systems permit the inclusion of multiple cutting portions with supports (62, 63) with a single system as depicted in FIG. 19. FIG. 19 shows two different styles of cutting portions, a slide cutter and a blade cutter. FIG. 19 shows sheet material exiting from the sheet material passage 55 and being passed to a blade cutter on the left and a slide cutter 63 on the right. Often embodiments will contain only a single roll of sheet material 60 in the housing, so either the left 62 or right 63 cutter may be used, or more frequently only a single cutting portion may be present. However, it is specifically contemplated that the housing is adapted to contain multiple sheet material rolls, which rolls 60 are in such embodiments arranged in the interior open chamber area 52 in a manner such that each sheet material can be dispensed simultaneous with each other. For example, the rolls 60 may be situated in opposite configurations with regard to the direction the sheet material separates from the roll, overhand vs. underhand. In such embodiments, the housing may be adapted to have a taller vertical stature and the eyelets are situated to suspend/support the sheet material within the housing with one roll positioned vertically above the other roll. Alternatively, the multiple sheet material rolls 60 may be placed side-by-side, or at an angle relative to one-another in the housing.

The housing system may be adapted to be a single piece clamshell arrangement as well (not depicted), with a top that is attached to one wall of the housing and the top opens and closes along an arc defined by the length of the top measured from its attachment to the wall of the housing. Such an embodiment can be configured to create a boundary gap between the top and the wall opposite the wall to which the top is attached when the top is in a closed position (i.e., closed shell) relative to the bottom portion. A lip in the top portion may be adapted in such embodiments to fit within/inside the opposite wall to secure the top in place, thereby creating a boundary gap 61.

A housing adapted as contemplated herein is useful in that it can be used over a prolonged period of time, with multiple successive or concurrent sheet material rolls and also different kinds of sheet materials. The contemplated housings are adapted to withstand the hard-use environments such as commercial kitchens and pantries. In this regard, the contemplated housings are configured with a housing material that is rigid and capable of being repeatedly sanitized or sterilized. One exemplary category of materials in this regard is polypropylene or other durable polymers such as plastic polymers including polyethylene, high density polyethylene (HDPE), Acrylonitrile butadiene styrene (ABS), Polyethylene terephthalate (PET), Polyvinyl chloride (PVC), among others, or combinations of two or more of the foregoing. Metals and metal alloys are another category of materials that can be used to form the housings of the present systems. In a kitchen environment, aerosols and liquids from uncooked or cooked food can contact the housing. If the housing was comprised of a porous material such as paper or cardboard, such aerosols and liquids could penetrate the material and become impossible to sanitize while maintaining structural integrity of the housing. Further, paper and cardboard housing materials are very poor at holding up structurally after repeated use and physical stress. The presently contemplated housing materials permit both a long duration of use across multiple sheet material rolls and the ability to sanitize the system to ensure a healthy environment day after day over the course of weeks, months or years. In certain embodiments, the housing system is adapted for daily use in a kitchen or pantry, including domestic and commercial iterations, for a period of at least 3 months, at least 6 months, at least one year, at least 2 years, or longer.

The housings described herein above are included together with a lid lock portion in frequent embodiments. Each arrangement of a housing contemplated herein may employ such a lid lock. For example, in a clam shell housing arrangement the lid lock position may be incorporated in a manner similar to its use with conventional sheet material dispensers. However, also in frequent embodiments the sheet material cutting portion is included with the housing without a lid lock portion.

An exemplary housing described above is also referred to herein as a sheet material dispenser or sheet material dispenser box. Stated differently, the housings described herein are adapted to form sheet dispensers or sheet material dispenser boxes.

The above examples are included for illustrative purposes only and are not intended to limit the scope of the disclosure. Many variations to those methods, systems, and devices described above are possible. Since modifications and variations to the examples described above will be apparent to those of skill in this art, it is intended that this invention be limited only by the scope of the appended claims.

One skilled in the art will appreciate further features and advantages of the presently disclosed methods, systems and devices based on the above-described embodiments. Accordingly, the presently disclosed methods, systems and devices are not to be limited by what has been particularly shown and described, except as indicated by the appended claims. All publications and references cited herein are expressly incorporated herein by reference in their entirety and/or for the specific reason for which they are cited herein.

We claim:

1. A sheet material dispenser system, comprising a sheet material dispenser and a sheet material cutter and a lid lock configured to be separate from and attachable to the sheet material dispenser;

wherein the sheet material dispenser comprises a cuboid box having a top lid, a bottom, a front side, a back side, and two opposing lateral sides, with the front side, the back side, the bottom and the top lid defining a longer dimension of the cuboid shaped box and the two opposing lateral sides defining a shorter dimension of the cuboid shaped box, wherein the top lid is attached to the back side along a length of the back side at an attachment line and is rotatable along the attachment line between an open position and a closed position to provide access to an open area adapted to hold a roll of sheet material, and wherein the roll of sheet material, when present, is oriented parallel with the longer dimension of the cuboid shaped box in the open area such that an end of the sheet material exits the box through the top lid at a gap parallel with the longer dimension of the cuboid shaped box;

wherein the lid lock comprises a vertical leg portion intersecting a horizontal lid locking portion forming an L-shaped body, the horizontal lid locking portion being a flat extension that protrudes perpendicularly from the vertical leg portion, the horizontal lid locking portion extends over and adjacent to the top lid and is configured to lock the top lid of the sheet material dispenser, the vertical leg is configured to attach to a front side or back side of the dispenser;

the sheet material cutter consisting of an abrasive surface adapted to cut the sheet material, wherein the sheet material cutter is positioned on the vertical leg portion.

2. The sheet material dispenser system of claim 1, wherein the lid lock is a physical barrier adapted to prohibit the top lid of the sheet material dispenser from moving from a closed position to an open position when the end of the sheet material is withdrawn through the top lid.

3. The sheet material dispenser of claim 1, further comprising an adhesive for attaching the lid lock to the front side or the back side of the sheet material dispenser.

* * * * *